US007312178B2

(12) United States Patent
Tamagawa et al.

(10) Patent No.: US 7,312,178 B2
(45) Date of Patent: Dec. 25, 2007

(54) BASE SUPPORT FOR IMAGE RECORDING MEDIUM AND METHOD OF MANUFACTURING THE SAME AND IMAGE RECORDING MEDIUM

(75) Inventors: Shigehisa Tamagawa, Shizuoka (JP); Fuyuhiko Mori, Shizuoka (JP); Yoshio Tani, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 595 days.

(21) Appl. No.: 10/975,350

(22) Filed: Oct. 29, 2004

(65) Prior Publication Data

US 2005/0170106 A1 Aug. 4, 2005

(30) Foreign Application Priority Data

Oct. 29, 2003 (JP) ..... 2003-369665
Jul. 12, 2004 (JP) ..... 2004-204413

(51) Int. Cl.
*B41M 5/40* (2006.01)

(52) U.S. Cl. ..... 503/227; 427/146; 428/32.21; 428/32.63; 428/211.1; 428/537.5

(58) Field of Classification Search ..... None
See application file for complete search history.

(56) References Cited

FOREIGN PATENT DOCUMENTS

| | | |
|---|---|---|
| JP | 6-55545 | 4/1987 |
| JP | 3-149542 | 6/1991 |
| JP | 11-11004 | 1/1999 |

*Primary Examiner*—Bruce H. Hess
(74) *Attorney, Agent, or Firm*—Young & Thompson

(57) ABSTRACT

A base support for an image recording material strikes a balance between high flatness and superb stiffness and is favorably available for various image recording mediums capable of providing high quality. The base support comprising at least base paper satisfying a ratio of subsurface internal bond strength A relative central internal bond strength B that is represented preferably by A/B≦0.7, and more preferably by 0.3≦A/B≦0.7. The subsurface internal bond strength is preferably from 90 to 150 mJ.

23 Claims, 1 Drawing Sheet

BASE SUPPORT FOR IMAGE RECORDING MEDIUM AND METHOD OF MANUFACTURING THE SAME AND IMAGE RECORDING MEDIUM

BACKGROUND OF THE INVENTION

1. Field of the Invention

The present invention relates to a base support for an image recording medium that has high flatness and excellent stiffness concurrently and a method for manufacturing the same and an image recording medium capable of creating high glossiness and superb smoothness of a print 2. Description of Related Art There are a variety of paper conventionally well known in the art as base supports for image recording mediums such as electrophotographic paper, heat sensitive printing paper, ink-jet printing paper, sublimation transfer printing paper, silver salt photographic paper, heat transfer printing paper and the like. Such the base support paper include, for example, base paper, synthetic paper, synthetic resin sheets, coated paper, laminated paper and so forth. In order to provide high quality prints with high glossiness and superb smoothness, these image recording mediums, and hence base supports of the image recording mediums consequentially, are demanded to have high surface flatness.

On the other hand, in order to record high quality images, there have been proposed image recording mediums and base supports for the image recording mediums in recognizing the importance of internal bond strength of paper. One of base supports for these image recording medium disclosed, for example, in Japanese Patent Publication No. 6-55545 is a base support for heat sensitive recording paper that has an internal bond strength between approximately 0.5 kgf·cm (49 mJ) and 1.5 kg·cm (147 mJ). Heat sensitive recording paper provides excellent dot reproductivity and is consequentially possessed of enhanced recording density. Another example is a base support for photographic paper disclosed in Japanese Unexamined Patent Publication No. 3-149542 that comprises base paper having an internal bond strength between approximately 1.0 kgf·cm (98 mJ) and approximately 2.0 kgf·cm (196 mJ). Photographic paper having this base support can provide prints with good preservation of strength and good showings. A further example is a base support for ink-jet recording paper disclosed in Japanese Unexamined Patent Publication No. 11-11004 that has an internal bond strength between approximately 0.9 kgf·cm (88 mJ) and 2.2 kgf·cm (215 mJ). Ink-jet recording paper having this base support creates high image quality and is flee from the problem of paper peeling.

However, all and singular of these citations does not in any way teach changing internal bond strength of the base support according to perpendicular depth nor suggest that a change in internal bond strength of the base paper plays a role in paper flatness and stiffness.

In the present circumstances, there is a strong demand for development of a base support that strikes a balance between high flatness and superb stiffness and image recording paper made of the base support that provides creates quality images with high glossiness and superb smoothness.

SUMMARY OF THE INVENTION

It is an object of the present invention to provide a base support that strikes a balance between high flatness and superb stiffness on a high level and is suitably available for a variety of image recording mediums, a method for efficient production of the base support, and image recording medium made of the base support that can record high quality images and create high glossiness and superb smoothness.

According to an aspect of the present invention the foregoing object of the present invention is accomplished by a base support for an image recording medium that comprises at least base paper satisfying a requirement of internal bond strength given by the following expression:

$$A/B \leqq 0.7$$

In the expression, A and B represents subsurface internal bond strength of the base paper at a depth within ⅓ of a thickness from either one surface of the base paper and central internal bond strength of the base paper at a depth at a depth within a range from ⅓ to ⅔ of thickness from a surface of base paper, respectively. These internal bond strength are defined by Japan Technical Association of the Pulp and Paper Industry, Inc. No. 54. The base support is preferred to satisfy a requirement of the internal bond strength given by the following expression:

$$0.3 \leqq A/B$$

More specifically, it is preferred for the base support to have subsurface internal bond strength in a range from 90 to 150 mJ and, in addition, central internal bond strength in a range from 160 to 250 mJ.

Furthermore, it is preferred for the base paper to have a thickness in a range from 50 to 250 μm and to contain an unstiffening agent desirably such as comprising at least either one of a softening agent and a bulking agent, or such as comprising a fatty acid contained compound of a carbon number in a range from 10 to 30. The fatty acid contained compound may comprise one selected from a group including epoxydized fatty acid amide, epoxidized fatty acid diamide salts, fatty acid ester added with an alkylene oxide and fatty acid quadrihydrate ammonium salts. Furthermore, it is preferred for the base paper to have a density in a range from 0.85 to 1.15 g/cm$^3$.

The base support comprising at least base paper that satisfies the ratio of internal bond strength A/B equal to or less than 0.7 strikes a balance between high flatness and superb stiffness on a high level. Further, the method of manufacturing the base support of the present invention that comprises the steps of coating one of opposite surfaces of the base paper with an unstiffening agent contained liquid and calender-processing the base paper after drying enables efficient production of the base support. Furthermore, the image recording medium that comprises the base support and the image recording layer formed on the base support provides prints with high quality image and create the print highly glossy and superbly smooth.

BRIEF DESCRIPTION OF THE DRAWINGS

The foregoing and other objects and features of the present invention will be clearly understood from the following detailed description when reading with reference to the accompanying drawings, in which the single FIGURE is a schematic representation of one of belt fixing devices for an image forming device used for forming images on image recording paper embodying the present invention.

DETAILED DESCRIPTION OF THE PREFERRED EMBODIMENTS

Figure 1:
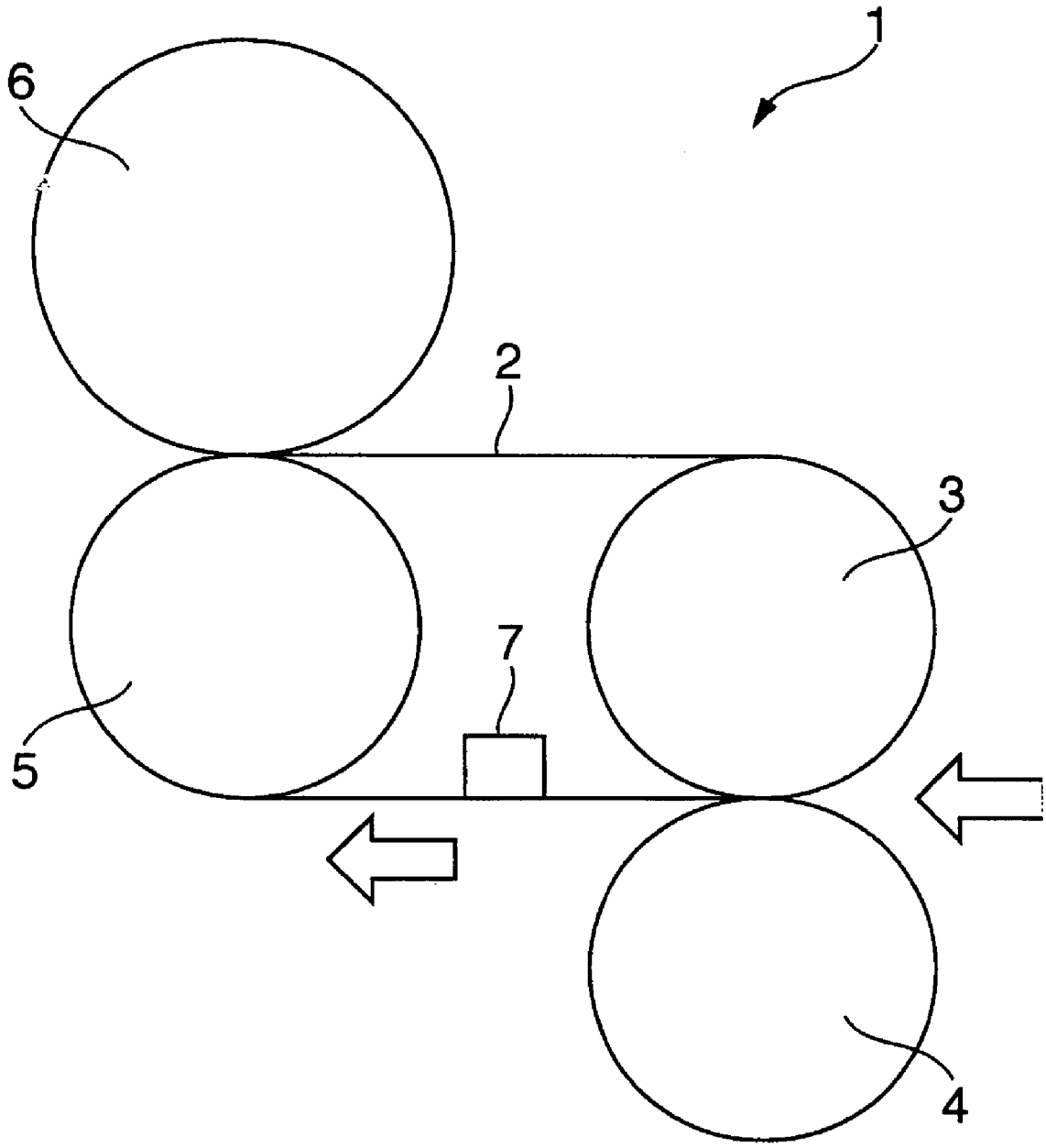

In the specification, the term "subsurface layer of base paper" as used herein shall mean and refer to a layer from a surface of the base paper to ⅓ of paper thickness from the surface, and the term "central layer of base paper" as used herein shall mean and refer to a layer from ⅓ to ⅔ of paper thickness from a surface of the base paper. Further, the term "subsurface internal bond strength" as used herein shall mean and refer to an internal bond strength, defined by Technical Association of the Pulp and Paper Industry, Inc. of Japan, No. 54, of the base paper at a depth within the subsurface layer, and the term "center internal bond strength" as used herein shall mean and refer to a bond strength, defined by Technical Association of the Pulp and Paper Industry, Inc. of Japan, No. 54, at a depth within the central layer.

[Base Support for Image Recording Paper]

A base support in the form of paper of the present invention comprises at least base paper and, if necessary, additional layers. The base paper has different internal bond strengths in a direction of thickness thereof. When letting A be a subsurface internal bond strength of the base paper at a depth within ⅓ of thickness from either one surface thereof and B a center internal bond strength at a half depth thereof, the base paper is essentially adjusted to have an internal bond strength ratio A/B equal to or less than 0.7 ($A/B \leqq 0.7$) as an essential requirement. The internal bond strength ratio A/B of the base paper is desirably higher than 0.3 and more desirably between 0.3 and 0.5. If the upper bond strength ratio A/B of 0.7 is exceeded, it is hard for the base paper to strikes a balance between flatness and stiffness favorably.

The subsurface internal bond strength A is not bounded to these ranges as long as meting the essential requirement and may be appropriately determined according to applications to image recording paper desirably in a range from 100 to 150 mJ and more desirably in a range from 110 to 140 mJ. If the lower subsurface internal bond strength A of 100 mJ is exceeded, the base paper leads to a deficiency in strength at its subsurface layer and possibly causes paper peeling due to the deficiency in strength. On the other hand, if the upper subsurface internal bond strength A of 150 mJ is exceeded, it is hard for the base paper to gain high flatness. The subsurface layer is preferably adjacent to a surface of the base support on which an image recording layer of an image recording paper is formed.

The center internal bond strength B is not bounded to those ranges as long as meting the desirable requirement and may be appropriately determined according to applications to image recording paper desirably in a range from 160 to 250 mJ and more desirably in a range from 180 to 230 mJ. If the lower center internal bond strength B of 160 mJ is exceeded, the base paper possibly leads to a deficiency in stiffness and, on the other hand, if the upper center internal bond strength B of 250 mJ is exceeded, the base paper is possibly apt to acquire obstinate curling disposition after storage in a roll.

The subsurface layer is preferably adjacent to a surface of the base support on which an image recording layer of an image recording paper is formed.

-Base Paper-

Examples of available base paper include, but not limited to, bond paper and paper enumerated in "Fundamentals of Photographic Engineering-Silver salt Photography-" at pages 223-240, edited by Japanese Society of Photograph and published 1979 by Corona Co., Ltd. Raw materials for the base paper include, but not limited to, various known materials, for example natural pulp, such as broad leaf tree pulp and coniferous tree pulp, and combined mixtures of natural pulp and synthetic pulp. Among them, it is preferred to use bleached broad leaf tree kraft pulp (LBKP) as a row material for the base paper in light of enhancing surface smoothness, stiffness and dimensional stability (curling disposition) all together to a sufficient and well balanced level. It is allowed to use bleached coniferous tree kraft pulp (NBKP), broad leaf tree sulfate pulp (LBSP) as a row material for the base paper. It is desirable from the viewpoint of fiber length to use broad leaf tree pulp that is shorter in fiber length by nature as a primary row material. It is preferred to use pulp having a mass average fiber length in a range from 0.45 to 0.70 mm. A beater or a refiner can be used to beat the pulp.

The pulp has a freeness that may be appropriately selectively determined preferably within, but not limited to, a range from 200 to 440 ml, and more preferably in a range from 250 to 350 ml, in Canadian Standard Freeness (C.S.F.). Further, the pulp has a Young's modulus ratio of longitudinal Young's modulus (Ea) relative to transversal Young's modulus (Eb) in a range of 1.5 to 2.0 for the purpose of improving stiffness and dimensional stability (curling disposition). If the Young's modulus ratio (Ea/Eb) is out of the range, i.e. less than 1.5 or greater than 2.0, the image recording paper using the base paper is apt to deteriorate its stiffness and curling disposition and, in consequence, undesirably degrades its mobility during conveyance.

It has been known that "toughness" of paper is different depending upon how the paper is beaten or refined. Generally, elastic force (a modulus of elasticity) of paper after milling can be employed as one of key factors representing the degree of "toughness" of paper. In particular, the modulus of paper can be find by the use of the following equation expressing the relationship between a dynamic modulus of elasticity of paper, that is representative of one of solid state properties associated with paper as a visco-elasticic body, density of paper and an the acoustic propagation velocity through paper that is measured with an ultrasonic traducer.

$$E=\rho c^2(1-n^2)$$

where E is the dynamic modulus of elasticity of paper;

ρ is a density of the paper;

c is an acoustic propagation velocity through the paper n is a Poisson's ratio.

Because Poisson's ratio n of ordinary paper is approximately 0.2 in the case of ordinary paper, the dynamic modulus of elasticity can be approximated by the following equation.

$$E=\rho c^2$$

That is, the modulus of elasticity of paper can be easily found whenever a density of paper and an acoustic propagation velocity of the paper can be measured. An acoustic propagation velocity of paper can be measured with various instruments well known in the art such as, for example, Sonic Tester SST-110 (which is manufactured by Nomura Co., Ltd.).

In order to create a desired average surface roughness of a paper surface, it is preferred to use pulp fibers having such a fiber length distribution as disclosed in, for example, Japanese Unexamined Patent Publication No.58-68037. Specifically, according to the distribution of fiber lengths, the pulp fibers contain a total part of residual pulp fibers screened with a 24-mesh screen and residual pulp fibers screened with a 42-mesh screen in, for example, a range from 20 to 45% by mass, and the part of residual pulp fibers screened with 24-mesh screen less than 5% by mass. The base paper can be adjusted in average surface roughness by applying heat and pressure treatment to its surfaces using a machine calender or a super calender.

The base paper has a thickness desirably in, but not limited to, a range from 50 to 250 μm, and more preferably in a range of from 100 to 200 μm. If the lower thickness of 50 μm is exceeded, the base paper possibly leads to aggravation of moisture-sensitive curling disposition and, on the other hand, if the upper thickness of 250 μm is exceeded, the base paper is possibly apt to acquire obstinate curling disposition after storage in a roll.

The base paper has a density desirably in, but not limited to, a range from 0.85 to 1.15 g/m$^2$, and more desirably in a range of from 0.95 to 1.05 g/m$^2$. If the lower density of 0.85 g/m$^2$ is exceeded, the base paper possibly leads to a deterioration in flatness and, on the other hand, if the upper thickness of 1.15 g/m$^2$ is exceeded, the base paper possibly leads to an occurrence of uneven brightness that is called blacking.

-Unstiffening Agent-

It is preferred for the base support for an image recording medium of the present invention to contain an unstiffening agent in the subsurface layer of the base paper and to be allowed to contain it in the central layer of the base paper. Examples of the unstiffening agent include, but not limited to, various unstiffening agents known in the art such as softening agents and balking agents. More specifically, preferable examples of the unstiffening agent include, but not limited to, fatty acid contained compounds. It is preferred for such a fatty acid contained compounds to have carbon atoms of a number between, but not limited to, 10 to 30. Preferred examples of the fatty acid contained compound include, but not limited to, epoxidized fatty acid amide, fatty acid diamide salts, alkylene oxide added fatty acid ester, an fatty acid quadrihydrate ammonium salts and the like. These fatty acid contained compounds may be used independently or in combination of two or more thereof. Actual examples of the epoxidized fatty acid amide include compounds expressed by the following structural formula (1):

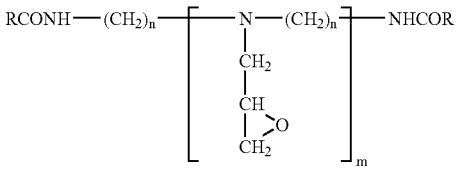

where R represents an alkyl group or alkenyl group, or may be replaced with a substituent, and n and m are integers, respectively Actual examples of the fatty acid diamide salt include compounds expressed by the following structural formula (2):

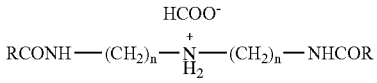

where R represents an alkyl group or an alkenyl group, or may be replaced with a substituent, and n is an integer.

In the structural formula, oleic diamide salts, that are expressed by the structural formula (2) in which R is represented by $C_{17}H_{33}$, are especially preferable.

Examples of the alkylene oxide added fatty acid ester include a fatty oil added with alkylene oxide and the like. These fatty acid contained compounds may be used independently or in any combination of two or more thereof. Examples of the fatty oil include terrestrial animal oils, aquatic animal oils, vegetable oils, hydrogenated or hardened oils of these animal oils, semihydrogenated or semihardened oils of these animal oils, and recovered oils yielded in a purification process of these animal oils, and more specifically, a palm oil, beef tallow, fish oils, a flaxseed (linseed) oil, a coleseed oil, a castor oil and the like. Preferred Examples of the alkylene oxide include an ethylene oxide, propylene oxide and the like. The number of added mole of the alkylene oxide is preferably 0 to 20 and more preferably 2 to 10. It is allowed to use substitutes that are made up by adding an alkylene oxide to a mixture of a fatty oil or a refined product of a fatty oil reacted with glycerin and a polyhydric alcohol such as alcohols having one to 14 hydroxyl. Examples of a monohydric alcohol include saturated or unsaturated alcohols having a straight chain or a branched chain having 1 to 24 carbon atoms and cyclic alcohols, more desirably saturated alcohols having a straight chain or a branched chain having 4 to 12 carbon atoms. Examples of the dihydric alcohol include α,ω-glycol, 1,2-ol, symmetry α-glycol, which have 2 to 32 carbon atoms and cyclic 1,2-diol. Among them, α,ω-glycol having 2 to 6 carbon atoms is desirable. Examples of the trihydric alcohol include glycerin, diglycerin, solbitol, stachyose, which have 3 to 24 carbon atoms. Dihydric to hexahydric alcohols having 2 to 6 carbon atoms, respectively, are especially desirable for the mixture.

Actual examples of the fatty acid quadrihydrate ammonium salts include compounds expressed by the structural formula (3) as set forth below, specifically: dihardened beef tallow dimethyl ammonium chloride; dipalmitoyl dimethyl ammonium chloride; bis(β-hydroxystearyl)-diethyl ammonium chloride; dihardenefd palm oil dimetyl ammonium chloride; distearyl dimethyl ammonium chloride; etc. These fatty acid quadrihydrate ammonium salts may be used independently or in any combination of two or more thereof.

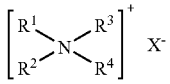

where $R^1$ and $R^2$ represent an alkyl group, an alkenyl group or a hydroxylalkyl group, each of which has 10 to 24 carbon atoms, $R^3$ and $R^4$ represent an alkyl group, a hydroxylallyl group, a benzyl group, or —$(C_2H_4O)_n$—, each pf which has 10 to 24 carbon atoms, and X represents halogen or a monoalkyl sulfate group that has an alkyl group having 1 to 3 carbon atoms.

It is preferred for the base paper to contain an unstiffening agent desirably greater than 0.4 parts by mass, more desirably between 0.4 and 1.5 parts by mass and most desirably between 0.6 and 1.2 parts by mass with respect to 100 parts by mass of the pulp, in the subsurface layer thereof. If the unstiffening agent content is less than 0.4 parts by mass, the subsurface internal bond strength A and the central internal bond strength B are possibly hard to meet the requirement of $A/B \leqq 0.7$ and, as a result, the base support for an image recording medium is apt to encounter a deterioration in surface flatness. On the other hand, the unstiffening agent content of the base paper in the center layer is desirably, but not limited to, less than 0.3 parts by mass, more desirably less than 0.1 part by mass and most desirably 0 with respect to 100 parts by mass of the pulp, in the center layer thereof. If the unstiffening agent content is greater than 0.1 part by mass, the subsurface internal bond strength A and the central internal bond strength B are possibly hard to meet the requirement of $A/B \leqq 0.7$ and, as a result, the base support for an image recording medium is apt to encounter a deterioration in stiffness.

In this instance the term "unstiffening agent content" as used herein shall mean and refer to a total content of part of the unstiffening agent that has reacted with the pulp and part of the unstiffening agent that has not reacted with the pulp, and, in the case of using, for example, epoxidized fatty acid amide as the unstiffening agent, the unstiffening agent content can be measured with the following process. That is, first of all, 10 g of paper samples of subsurface and center layers of the base paper, respectively, are prepared. Then, in order to extract epoxidized fatty acid amide unreacted with the pulp from the subsurface layer paper sample, the subsurface layer paper sample is dried up by distillation in an extraction solution of n-butanol at 130° C. and then, hydrodized and n-butyl esterified at 130° C. for six hours after making an addition of 2.4 normal concentration of hydrochloric acid solution thereto. Subsequently, the resultant solution is treated with 50 ml of chloroform two times to extract epoxidized fatty acid amide. The epoxidized fatty acid amide extracted is dried with 20 g of sodium sulfate. The poxidized fatty acid amide unreacted with the pulp is determined in quantity on gas chromatography (column chromatography: DB-FFAP). Similarly, in order to extract epoxidized fatty acid amide reacted with the pulp from the center layer paper sample, the center layer paper sample is dried up by distillation in an extraction solution of n-butanol and then, hydrodized and n-butyl esterified at 130° C. for six hours after making an addition of 10% concentration of hydrochloric acid solution thereto. Subsequently, the resultant solution is treated with 50 ml of chloroform two times to extract epoxidized fatty acid amide. The epoxidized fatty acid amide extracted is dried with 20 g of sodium sulfate. The poxidized fatty acid amide reacted with the pulp is determined in quantity on gas chromatography (column chromatography: DB-FFAP). The content of poxidized fatty acid amide is determined in quantity as a total of the two result values.

-Other Components-

The base support for an image recording medium may further contain one or more additives in accordance with intended use, namely types of image recording paper. Useful examples of such additives include a filler, a dry paper strength fortifier, a sizing agent, a wet paper strength fortifier, a fixing agent, a pH adjuster and other chemical conditioners or agents.

Preferable examples of the loading material include calcium carbonate, clay, kaolin, a white earth, talc, a titanium oxide, a diatom earth, barium sulfate, an aluminum hydroxide, a magnesium hydroxide, etc. Preferable examples of the dry paper strength fortifier include cationized starch, cationized polyacrylamide, anionic polyacrylamide, amphoteric polyacrylamide, carboxy-modified polyvinyl alcohol, etc. Preferable examples of the sizing agent include fatty acid salts, rosin, rosin derivatives such as maleic rosin, paraffin wax, compounds having a higher fatty acid such as an alkylketene dimmer or an alkenyl anhydrous succinic acid (ASA), etc. Among them, an alkylketene dimmer is especially preferred.

Preferable examples of the wet paper strength fortifier include polyamine polyamide epichlorohydrin, a melamine resin, a urea resin, an epoxidized polyamide resin, etc. Preferable examples of the fixing agent include polyvalent metal salts such as aluminum sulfate, aluminum chloride, etc., a cationic polymers such as cationized starch, etc. Preferable examples of the pH adjuster include caustic soda, sodium carbonate, etc.

Examples of other chemical additives include antifoaming agents, dye, slime control agents, fluorescent brightening agents, etc. These additives may be used independently or in any combination of two or more thereof. The individual additive content of the paper stock is desirably, but not limited to, between 0.1 and 1.0% by mass.

The base paper is made up of a pulp stock added with one or more of the additives described above by the use of a paper machine such as a hand paper machine, a fourdrinier paper machine, a cylinder paper machine, a twin-wire machine or a combination machine and then dried. After or before drying the base paper, surface sizing may be applied to the base paper as appropriate. Examples of a sizing liquid includes, but not limited to, water-soluble polymers, sizing agents, water resistant materials, pigment, pH adjusters, dye, fluorescent brightening agents, etc.

Examples of the water-soluble polymers include a cationized starch, polyvinyl alcohol, carboxy-modified polyvinyl alcohol, carboxy methyl cellulose, hydroxylethyl cellulose, cellulose sulfates, gelatin, casein, sodium polyacrylate, sodium salts of styrene-maleic anhydride copolymer, sodium, polystyrene sulphonic acid, etc. Examples of the water resistant materials include latex or emulsion such as styrene-butadiene copolymers, ethylene-vinyl acetate copolymers, polyethylene, vinylidene chloride copolymers, etc., polyamide polyamine epichlorohydrin and the like. Examples of the pigment include calcium carbonate, kaolin, talc, barium sulfate, titanium oxides, etc.

It is preferred to make the paper by press drying wet paper that is prepared by dehydrating paper stock with a hand stainer or the like and wet-pressing it. It is preferred for the base paper before press-drying to have a moisture content desirably between 30 and 70% and more desirably between 45 and 60%. If the moisture content of the base paper is les than 30%, the base paper is possibly deficient in paper strength, and, on the other hand, if exceeding 70%, it is feared that the base paper after press-dying crumbles. The moisture content of the base paper may be measured in conformity with Japanese Industrial Standards (JIS) P8127.

The base support meeting the internal bond strength requirement of $A/B \leqq 0.7$ strikes a balance between high flatness and superb stiffness on a high level and is suitably available for a variety of image recording paper capable of printing high quality images thereon and, especially for the image recording medium of the present invention. Preferred examples of uses of the base paper include, but not limited to, electrophotographic paper, heat-sensitive printing paper, sublimation transfer printing paper, ink jet printing paper, silver salt photographic paper, etc.

(Process of Producing Base Support for Image Recording Medium)

The base support for an image recording medium is produced through a process including the steps of applying or coating the unstiffening agent contained liquid to surfaces of the base paper described above, calendering the base paper by the use of a calender machine having a metal roll or rolls at a surface temperature higher than 140° C. and applying other steps as appropriate. The unstiffening agent contained liquid is not limited to as long as containing the unstiffening agent referred to above. It is allowed to apply the unstiffening agent alone or by mixture with a solvent well known in the art.

Preferable example of the method of unstiffening agent coating include, but not limited to, a spin coat method, a bar coat method, a roll coat method, a kneader coat method, a curtain coat method, a die coat method, a blade coat method, a dip coating method, a spray coating method, a doctor blade coat method, a gravure coating method, etc.

The calender machine is not limited to as long as having a metal roller. Examples of the calender machine include a soft calendar machine with a combination of a metal roller and a synthetic resin roller, a machine with a machine calendar roller comprising a couple of metal rollers, etc. Among them, the soft calender machine, in particular a long nip type of shoe calender machine equipped with a metal roller and a shoe roller connected to metal roller through a synthetic belt, is preferred because it can provide a long nip width from 50 to 270 mm so as thereby to increase a contact area between the base paper to the rollers.

The metal roller is at a surface temperature desirably higher than 140° C., more desirably higher than 200° C., and most desirably higher than 250° C. A ceiling may be put on the surface temperature and, in such a case, it is preferred to draw an approximately 300° C. as the ceiling on the surface temperature, but not limited to the 300° C. ceiling. Further, it is preferred to perform the calendering at a nip pressure desirably, but not limited to, higher than 100 $kN/cm^2$ and more desirably between 100 and 600 $kN/cm^2$.

The base support can be adjusted in subsurface internal bond strength and central internal bond strength in a desired range by selectively using the coating methods together with selectively determining a coating time and a spread of the unstiffening agent contained liquids and can be further provided with high flatness by means of the above mentioned calendering, At the same time, the base support can be produced efficiently at a low cost.

(Image Recording Medium)

The image recording medium of the present invention comprises the base support previously described and at least an image recording layer formed on the base support, and if necessary, other layers. There are various image recording mediums different according to intended purposes and types, namely: electrophotographic paper, heat-sensitive printing paper; sublimation transfer printing paper; thermal transfer printing paper; silver salt photographic paper, ink-jet printing paper; etc.

<Electrophotographic Paper>

The electrophotographic paper of comprises the base paper (base support) described above and at least one toner image receiving layer formed on at least one of opposite surfaces of the base paper and, if necessary, may further comprise additional layers including, for example, a surface protective layer, a back layer, an intermediate layer, an undercoating layer, a cushioning layer, an electrostatic charge control or antistatic layer, a reflective layer, a color tincture adjusting layer, a storage stability improvement layer, an anti-adhesion layer, an anti-curling layer, a smoothing layer, etc. Each of these layers may have a single layer structure or a multi-layered structure.

[Toner Image Receiving Layer]

The toner image receiving layer accepts a color toner or a monochrome toner in the form of image from a developing drum or an intermediate transfer medium by means static electricity or pressure in an image transfer process and then fixes the toner image with heat or pressure in a fixing process. It is preferred for the toner image receiving layer to have a low transparency, namely desirably less than 78%, more desirably less than 73% and most desirably less than 72% in optical transmittance in light of providing electrophotographic paper with a feel like a photoprint. The optical transmittance can be found by, for example, measuring an optical transmittance of a sample toner layer of the same thickness as the toner image receiving in question coated on a polyethylene terephthalate film of 100 μm in thickness by the use of a direct reading Hayes meter (HGM-2DP manufactured by Suga Testing Machine Co., Ltd.). The toner image receiving layer contains at least a thermoplastic resin and, if desired, further additives for the purpose of improving thermodynamic properties, namely: a releasing agent, a unstiffening agent, a coloring agent, a filler, a cross-linking agent, an electrostatic charge control agent, an emulsifier, a dispersing agent, etc.

-Thermoplastic Resin-

Examples of the thermoplastic resin include, but not limited to, (1) polyolefin resins, (2) polystyrene resins, (3) acrylic resins, (4) polyvinyl acetate or derivatives of polyvinyl acetate, (5) polyamide resins, (6) polyester resins, (7) polycarbonate resins, (8) polyether resins or acetal resins, and (9) other resins. These resins may be selectively used independently or in any combination of two or more thereof. Among them, styrene resins, acrylic resins and polyether resins that have higher cohesive energy are suitable in the viewpoint of burying a toner.

Preferred examples of the polyolefin resins include polyolefin resins such as polyethylene and polypropylene, copolymer resins of olefin such as ethylene or propylene polymerized with vinyl monomers. Examples of the copolymer resins include ethylene-vinyl acetate copolymers and ionomer resins that are copolymers polymerized with an acrylic acid or a methacrylic acid. In this instance, derivatives of polyolefin resin include chlorinated polyethylene and chlorosulfonated polyethylene.

Preferred examples of the polystyrene resins include polystyrene resins, styrene-isobutylene copolymers, styrene-isobutylene copolymers, acrylonitrile-styrene copolymers (AS resins), acrylonitrile-butadiene-styrene copolymers (ABS resins), polystyrene-maleic anhydride resins, etc.

Preferred examples of the acrylic resins include polyacrylic acids and their ester, polymethacrylic acids and their ester, poly acrylonitrile, polyacrylamide, etc. The ester of polyacrylic acids include homopolymers of ester of acrylic acids and multiple copolymers. Examples of the ester include methyl acrylate, ethyl acrylate, n-butyl acrylate, isobutyl acrylate, dodecyl acrylate, n-octyl acrylate, 2-ethylhexyl acrylate, 2-chrolethyl acrylate, phenyl acrylate, α-chrolmethyl acrylate, etc. Examples of the ester of polymethcrylic acids include homopolymers of ester of methacrylic acids and multiple copolymers of ester of methacrylic acids. Examples of the ester of polymethacrylic acids include methyl methacrylate, ethyl methacrylate, butyl methacrylate, etc.

Preferred examples of the polyvinyl acetate or their derivatives include polyvinyl acetate, polyvinyl alcohol derived by saponifying polyvinyl acetate, and polyvinyl acetal resins derived by reacting polyvinyl alcohol to aldehyde such as formaldehyde, acetaldehyde, butylaldehyde, etc.

The polyamide resins, that are condensation polymers of diamine and dibasic acid, include, for example, 6-nylon and 6,6-nylon.

The polyester resins can be produced from condensation polymerization of acid components and alcoholic components. Preferred examples of the acid components include, but not limited to, maleic acids, fumaric acids, citraconic acids, itaconic acids, glutaconic acids, phtalic acids, telephtalic acids, succinic acids, adipic acids, sebacic acids, azelalc acids, malonic acids, n-dodecenylsuccinic acids, isododecenylsuccinic acids, n-dodecylsuccinic acids, isododecylsuccinic acids, n-octotenyalsuccinic acids, n-octylsuccinic acids, isooctylsuccinic acids, isooctotenyalsuccinic acids, isooctylsuccinic acids, trimellitic acids, pyromellitic acids, anhydrates of them, and lower alkyl ester of them. Preferable alcohol component include, but not limited to, dihydric alcohol. Examples of aliphatic diol inclide ethylene glycol, diethylene glycol, triethylene glycol, 1,2-propylene glycol, 1,3-propylene glycole, 1,4-butandiol, neopentyl glycol, 1,4-butenediol, 1,5-pentadiol, 1,6-hexadiol, 1,4-cyclohexane dimethanol, dipropylene glycol, polyethylene glycol, polypropylene glycol, polytetramethylene glycol, etc. Examples of bisphenol A with an addition of alkylene oxide include polyoxypropylene (2.2)-2,2-bis(4-hydroxyphenyl) propane, polyoxypropylene (3.3)-2,2-bis(4-hydroxyphenyl) propane, polyoxyethylene (2,0)-2,2-bis(4-hydroxyphenyl) propane, polyoxypropylene (2.0)-polyoxyethylene (2,0)2,2-bis(4-hydroxyphenyl) propane, polyoxypropylene(6)-2,2-bis(4-hydroxyphenyl) propane, etc.

General examples of the polycarbonate resins generally include polycarbonic acid ester obtainable from bisphenol A and phosgene.

Preferred examples of the polyether resins include polyethylene oxides and polypropylene oxides. Further, examples of the acetal resins include polyoxymethylene and the loke that are of a ring-opening polymerization type.

Preferred examples of other resins include polyurethane resins and the like that are of a polyaddition type.

In this instance, it is preferred that each individual thermoplastic resin is such that the toner image receiving layer comprising the thermoplastic resin in a tangible form satisfies solid state properties which is described in the section on "Solid State Properties of Toner" and more preferred each individual thermoplastic resin itself satisfies the solid state properties. It is also preferred to use more than two thermoplastic resins having different solid state properties required for the toner. More specifically, it is desirable for the thermoplastic resin for the toner image receiving layer to have a molecular weight greater than a molecular weight of a thermoplastic resin used for a toner. However, this relationship between molecular weights of these two thermoplastic resins for the toner image receiving layer and the toner is not always preferred depending upon the relationship between thermodynamic characteristics of them. Taking an instance, in the case where the thermoplastic resin for the toner image receiving layer has a softening temperature higher than the thermoplastic resin for the toner, it is preferred in some cases that the thermoplastic resin for the toner image receiving layer has a molecular weight equal to or less than the thermoplastic resin for the toner.

It is desirably allowed to use a mixture of different thermoplastic resins identical in composition but different in average molecular weight for the toner image receiving layer. The desirable relationship between molecular weights of thermoplastic resins for the toner image receiving layer and the toner is such as disclosed in Japanese Unexamined Patent Publication No. 8 (1996)-334915. It is further preferred for the thermoplastic resin for the toner image receiving layer to have a molecular weight distribution wider than the thermoplastic resin for the toner.

It is preferred for the thermoplastic resin for the toner image receiving layer to satisfy such solid state properties as disclosed in Japanese Unexamined Patent Publication Nos. 5(1993)-127413, 8(1996)-194394, 8(1996)-334915, 8(1996)-334916, 9(1997)-171265 and 10(1998)-221877.

The thermoplastic resin suitably used for the toner image receiving layer is of an aqueous type of resin such as a water-soluble polymers and water-dispersant polymers for the following reasons: that the aqueous type resin excels at environmental adaptability and suitability for working in a coating and drying process due to nondischarge of organic solvent: that a releasing agent such as wax is hardly soluble in water at an ambient temperature in many instances and is often dispersed in a solvent such as water or an organic solvent in using it; that the water-dispersant type of resin is stable and excels at adaptability to manufacturing process; and that wet coating causes wax to easily bleed onto a surface in the coating and drying process and, in consequence, it is easy to bring out the effect of the releasing agent (offset resistance, adhesion resistance, etc.).

The aqueous type resin is not always bounded by chemical composition, bond-structure, molecular structure, molecular weight, molecular weight distribution, conformation inasmuch as it is a water-soluble polymer or a water-dispersant polymer. Preferred examples of hydrating group for the polymers include a sulfonic acid group, a hydroxyl group, a carboxylic acid group, an amino group, an amid group, an ether group, etc.

The water-dispersant polymer can be selected from water-dispersions of the respective thermoplastic resins (1) to (9) previously described under the section regarding thermoplastic resin, emulsions of them, copolymers of them, mixtures of them and cation-modified products of them, independently or in any combination of more than two different kinds of them. It is allowed to use a water-dispersant polymers appropriately synthesized polymers or commercially available water-dispersant polymers. Commercially available examples of water-dispersant polyester polymers include a Vyronal series of polymers (which are manufactured by Toyobo Co., Ltd.); a Pesuresin A series of polymers (which are manufactured by Takamatsu Oil & Fats Co., Ltd.); a Tafuton UE series of polymers (which are manufactured by Kao Co., Ltd.); a Polyester WR series of polymers (which are manufactured by Nippon Synthetic Chemical Industry Co., Ltd.), a Polyester WR series of polymers (which are manufactured by Unitika Ltd.) and the like.

Preferred examples of the water-dispersant emulsions include, but not limited to, water-dispersant polyurethane emulsions, water-dispersant polyester emulsions, chloroprene emulsions, styrene-butadiene emulsions, nitryl-butadiene emulsions, butadiene emulsions, vinyl chloride emulsions, vinyl pyridine-styrene-butadiene emulsions, polybutene emulsions, polyethylene emulsions, vinyl acetate emulsions, ethylene-vinyl acetate emulsions, vinylidene chloride emulsions, methyl-methacrylate-butadiene emulsions, etc. The water-dispersant polyester emulsions are particularly preferable among them. Specifically, it is desirable for the water-dispersant polyester emulsions to be of a self-dispersant aqueous type, and, in particular, carboxyl group contained self-dispersant aqueous type polyester resin emulsions are suitable among them. The term "self-dispersant aqueous type polyester emulsion" as used herein shall mean and refer to the aqueous type emulsion containing a polyester resin self-dispersible in an aqueous type solvent, and the term "carboxyl group contained self-dispersant aqueous type polyester resin emulsion" as used herein shall mean and refer to the aqueous type emulsion containing a hydrophilic group in the form of carboxyl group and a polyester resin self-dispersible in an aqueous type solvent.

It is preferred for the self-dispersant aqueous type polyester emulsion to meet the following peculiarities (a) to (d) for the reason that, because of the absence of surface-active substance, the self-dispersant emulsion is low in moisture-absorption characteristics even in a humid atmosphere, cases a small decease in softening point, reins in offset during fixation and inter-sheet adhesion defect during storage and that, because of aqueous type, the self-dispersant emulsion excels at environmental adaptability and workability, and that, because a polyester resin that is apt to take a molecular structure having high cohesive energy is used, the self-dispersant emulsion grows into a low elasticity or low viscosity molten state during an electrophotographic fixing process while having a sufficient hardness in storage environments, so as to enable achievement of sufficient image quality resulting from burying a toner in the toner image receiving layer.

(a) Number-average molecular weight: desirably between 5000 and 10000 and more desirably between 5000 and 7000;

(b) Molecular weight distribution (weight-average molecular weight/number-average molecular weight): desirably less than 4 and more desirably 3;

(c) Glass transition temperature: desirably between 40 and 100° C. and more desirably between 50 and 80° C.;

(d) Volume-average particle size: desirably between 20 and 200 nm and more desirably between 40 and 150 nm.

The water-dispersive emulsion content of the toner image receiving layer is preferably between 10 and 90% by mass and more preferably between 10 and 70% by mass.

Available examples of the water-soluble polymers may include, but not limited to, synthesized polymers and commercially available polymers. Preferred examples of the synthetic polymers include polyvinyl alcohol, carboxy-modified polyvinyl alcohol, carboxy methylcellulose, hydroxyethyl cellulose, cellulose sulfate, polyethylene oxides, gelatin, cationized starch, casein, sodium polyacrylate, styrene-sodium maleic anhydride copolymers, sodium polystyrene sulfate, etc. Among them, polyethylene oxides are especially suitable. The commercially available water-soluble polymers includes water-soluble polyester such as various types of Pluscoat polyester (which are manufactured by Gao Chemical Industry Co., Ltd.), a Fintex ES series of polyester (which are manufactured by Dainippon Ink & Chemical Inc.) and water-soluble acryl such as a Jurimar AT series of acryl (which are manufactured by Nippon Fine Chemical Co., Ltd.), Fintex 6161 and Fintex K-96 (which are manufactured by Dainippon Ink & Chemical Inc.), Hyros NL-1189 and Hyros BH-997L (which are manufactured by Seiko Chemical Industry Co., Ltd.), etc. Further examples of water-soluble polymer include those disclosed in Research Disclosures No. 17-643, page 26; No. 18-716, page 651; No. 307-105, pages 873-874; and Japanese Unexamined Patent Publication No. 64(1989)-13546.

The water-soluble polymer content of the toner image receiving layer is, but not limited to, preferably between 0.5 and 2 g/m$^2$.

Each of the thermoplastic resins described above can be used in combination with other polymer materials and, in such cases, is generally adjusted so as to be contained over the other polymer material.

The thermoplastic resin content of the toner image receiving layer is preferably greater than 10% by mass, more preferably 30% by mass and most preferably between 50 and 90% by mass.

-Releasing Agent-

The releasing agent is blended in the toner image receiving layer in order to prevent the toner image receiving layer from offsetting. Various releasing agents can be used without any particular restriction to their types as long as they are heat-melted at a fixing temperature sufficiently enough to precipitate onto the surface of the toner image receiving layer in an unevenly-distributed state and further forms a layer of the releasing agent material on the toner image receiving layer resulting from cooling and solidification. Examples of releasing agents include silicon compounds, fluorine compounds, waxes and matting agents. Specifically, preferable examples of the releasing agents include waxes disclosed in "Revised Edition: Property and Application of Wax" (published by Koushobou), compounds disclosed in "Silicone Handbook" (published by Nikkan Kogyo Shinbun), and silicone compounds, fluorine compounds and waxes that are used for toners such as disclose in Japanese Patent Nos. 2,838,498 and 2,949,558; Japanese Patent Publication Nos. 59(1984)-38581 and 4(1992)-32380; Japanese Unexamined Patent Publication Nos. 50(1975)-117433, 52(1977)-52640, 57(1982)-148755, 61(1986)-62056, 61(1986)-62057, 61(1986)-118760, 2(1990)-42451, 3(1991)-41465, 4(1992)-212175, 4(1992)-214570, 4(1992)-263267, 5(1993)-34966, 5(1993)-119514, 6(1994)-59502, 6(1994)-161150, 6(1994)-175396, 6(1994)-219040, 6(1994)-230600, 6(1995)-295093, 7(1995)-36210, 7(1995) 43940, 7(1995)-56387, 7(1995)-56390, 7(1995)-64335, 7(1995)-199681, 7(1995)-223362, 7(1995)-287413, 8(1996)-184992, 8(1996)-227180, 8(1996)-248671, 8(1996)-2487799, 8(1996)-248801, 8(1996)-278663, 9(1997-152739, 9(1997)-160278, 9(1997)-185181, 9(1997)-319139, 9(1997)-319413, 10(1998)-20549, 10(1998)-48889, 10(1998)-198069, 10(1998)-207116, 11(1999)-2917, 11(1999)-449669, 11(1999)-65156, 11(1999)-73049 and 11(1999)-194542. These compounds can be used individually or in any combination of two or more thereof.

More specifically, there are various silicone compounds for the releasing agent such as silicone oils, silicone rubbers, silicone fine particles, silicone-modified resins, reactive silicone compounds, etc available as the releasing agent. Reciting several examples of them, preferable examples of silicone oils include non-modified silicone oils, amino-modified silicone oils, carboxy-modified silicone oils, carbinol-modified silicone oils, vinyl-modified silicone oils, epoxy-modified silicone oils, polyether-modified silicone oils, silanol-modified silicone oils, methacryl-modified silicone oils, mercapto-modified silicone oils, alcohol-modified silicone oils, alkyl-modified silicone oils, fluorine-modified silicone oils, etc. Preferable examples of silicone-modified oils include silicone-modified products from resins such as olefin resins, polyester resins, vinyl resins, polyamide resins, cellulose resins, phenoxy resins, vinyl chloride-vinyl acetate resins, urethane resins, acryl resins, styrene-acryl resins, copolymers of them, Available examples of fluorine compound for the releasing agent include, but not limited to, fluorine oils, fluorine rubbers, fluorine-modified resins, compounds of fluorine and sulfonic acid, a fluorosulfonic acid, fluorine compounds, salts of fluorine compounds, inorganic fluoride, etc.

Preferable examples of wax are divided broadly into two types, namely natural waxes and synthetic waxes.

Examples of natural wax include vegetable waxes, animal wax, animal waxes, mineral waxes and petroleum waxes. Among them, the vegetable waxes are especially preferable. In particular, water-dispersant type of natural wax is preferred in light of compatibility in the case where an aqueous resin is used for a polymer of the toner image receiving layer.

Examples of vegetable wax include, but not limited to, waxes conventional known in the art, commercially available waxes and synthetic waxes. Specifically, preferable examples of vegetable wax include carnauba waxes, (one of which is commercially available under the name of EMUSTAR-0413 from Ito Oil Manufacturing Co., Ltd. Or under the name Serozole 524 from Chukyo Oils & Fats Co., Ltd.), castor oils (one of which is fine castor oil commercially available from Ito Oil Manufacturing Co.), colza oils, soybean oils, sumac waxes, cotton waxes, rice waxes, sugarcane waxes, canderyla waxes, Japan waxes, jojoba oils, etc. Among them, the carnauba waxes that have melting temperatures in a range from 70 to 95° C., are especially preferable in light of providing the electrophotographic image recording mediums that excel in offset resistance, adhesion resistance, pass-though ability to pass though electrophotographic equipments and glossy impression, hardly causing cracks and forming high quality images.

Preferable examples of animal wax include, but not limited to, those conventionally known in the art such as bees waxes, lanolin, spermaceti, blubber (whale oil) and wool wax.

Preferable examples of mineral wax include, but not limited to, waxes conventional known in the art, commercially available waxes and synthetic waxes such as montan waxes, montan ester waxes, ozokerite, ceresin, etc. Among them, the montan waxes that have melting temperatures in a range from 70 to 95° C., are especially preferable in light of providing the electrophotographic image recording mediums that excel in offset resistance, adhesion resistance, pass-though ability to pass though electrophotographic equipments and glossy impression, hardly causing cracks and forming high quality images.

Preferable examples of petroleum wax include, but not limited to, waxes conventional known in the art, commercially available waxes and synthetic waxes such as paraffin waxes, microcrystalline waxes, petrolatum, etc.

The natural wax content of the toner image receiving layer is preferably in a range from 0.1 to 4 g/m$^2$, and more preferably in a range from 0.2 to 2 g/m$^2$. If the natural wax content is less than 0.1 g/m$^2$, significant deterioration in, in particular, offset resistance and adhesion resistance will occur. On the other hand, if the natural wax content is beyond 4 g/m$^2$, the wax is too much to prevent an occurrence of a deterioration in image quality. It is preferred for the natural wax to have a melting temperature in a range from 70 to 95° C., and more preferably in a range from 75 to 90° C., in light of, in particular, offset resistance and pass-though ability to pass though electrophotographic equipments.

Preferable examples of synthetic wax are divided into several types, namely synthetic hydrocarbons, modified waxes, hydrogenated waxes and fat and oil synthetic waxes except them. A water-dispersant type of synthetic wax is preferred in light of compatibility in the case where an aqueous thermoplastic resin is used in the toner image receiving layer.

Specifically, examples of synthetic hydrocarbon include Fischer-Tropsch waxes, polyethylene waxes, etc. Examples of fat and oil synthetic wax include acid amide compounds such as amide stearate, acid imide compounds such as imide dihydrogen phthalate, etc. Examples of modified wax include, but not limited to, amine-modified waxes, acrylic acid-modified waxes, fluorine-modified waxes, olefin-modified waxes, urethane type waxes, alcohol type waxes, etc. Examples of hydrogenated wax include, but not limited to, hydrogenated castor oils, derivatives of castor oils, stearic acids, lauric acids, myristic acids, palmitic acids, behenic acids, sebacic acids, undecylenic acids, heptyl acids, maleic acids, higher maleic oil, etc.

It is preferred for the releasing agent to have a melting temperature in a range from 70 to 95° C., and more preferably in a range from 75 to 90° C., in light of offset resistance and pass-though ability to pass though electrophotographic equipments of the electrophotographic image recording mediums. It is further preferred for the releasing agent to have a content in a range from 0.1 to 10% by mass, more preferably in a range from 0.3 to 8.0% by mass, and most preferably in a range from 0.5 to 5.0% by mass, with respect to the total mass of toner image receiving layer. If the releasing agent content is less than 0.1% by mass, significant deterioration in, in particular, offset resistance and adhesion resistance will occur. On the other hand, if the releasing agent content is beyond 10% by mass, the releasing agent is too much to prevent an occurrence of a deterioration in image quality.

-Plasticizing Agent-

Various plasticizing agents conventionally known in the art can be used without any particular restriction. The plasticizing agent has the function of controlling fluidization or softening of the toner image receiving layer due to heat and/or pressure applied thereto upon fixing the toner. The plasticizing agent can be selected consulting "Handbook of Chemistry" by Chemical Society of Japan (published by Maruzen), "Plasticizer-Theory and Applications-" by Kouichi Murai (published by Koushobou), "Study on Plasticizer Vol. 1" and "Study on Plasticizer Vol. 2" both by Polymer Chemistry Association, "Handbook: Rubber-Plastics Compounding Chemicals" by Rubber Digest Ltd., etc.

More specifically, although there are exemplified in the simililtude of high boiling organic solvent or thermal solvent, preferable examples of unstiffening agent include compounds, namely: esters (e.g. phthalate esters, phosphate esters, fatty acid esters, abietate, adipate, sebacate, azelate, benzoate, butyrate, epoxidized fatty acid esters, glycolate, propionate, trimellitate, citrate, sulfonate, calboxylate, succinate, maleate, fumarate, futalate, stearate, etc.), amide (e.g. fatty acid amide, sulfoamide, etc.) ether; alcohol; lactone; polyethyleneoxy; and the like such as disclosed in, for example, Japanese Unexamined Patent Publication Nos. 59(1984)-83154, 59(1984)-178451, 59(1984)-178453, 59(1984)-178454, 59(1984)-178455, 59(1984)-178457, 61(1986)-09444, 61(1986)-2000538, 62(1987)-174745, 62(1987)-245253, 62(1987)-8145, 62(1987)-9348, 62(1987)-30247, 62(1987)-136646, and 2(1990)-235694. The respective plasticizing agent can be used as a mixture with a resin or resins.

Comparatively low molecular weight polymers can be used as the plasticizing agent. The plasticizing agent has a molecular weight preferably lower than a binder resin to be plasticized. More specifically, the molecular weight of plasticizing agent is preferably lower than 15000 and more preferably lower than 5000. When a polymer plasticizing agent is used, it is preferred to be of the same sort of polymer as a binder resin. For example, a lower molecular weight of polyester is preferred in for plasticization of a polyester resin. Further, oligomers can be used as the plasticizing agent.

There are commercially available plasticizing agents other than the above mentioned compounds. Examples of commercially available plasticizing agent include Adecasizer PN-170 and Adecasizer PN-1430 (manufactured by Asahi Denka Kogyo K.K.), PARAPLEX-G-25, PARAPLEX-G-30 and PARAPLEX-G-40 (manufactured by C. P. HALL Corporation), and Estergum 8L-JA, Ester R-95, Pentaryn 4851, Pentaryn FK115, Pentaryn 4820, Pentaryn 830, Ruizol 28-JA, Picorastic A75, Picotex LC and Crystalex 3085 (manufactured by Rika Hercules Co., Ltd.), etc.

The plasticizing agent is optionally used in order to relief stress and distortion (physical distortion such as elastic force and viscosity, distortion of molecules, main chains and pendants due to material balance) that occur when toner particles are buried in the toner image receiving layer. The plasticizing agent may be present in the toner image receiving layer in a microscopically dispersed state, a microscopically phase separated state like a sea-island pattern or a state where the plasticizing agent is sufficiently mixed with and dissolved in other components such as a binder. The plasticizing agent content is preferably in a range from 0.001 to 90% by mass, more preferably in a range from 0.1 to 60% by mass, and most preferably in a range from 1 to 40% by mass, with respect to the total mass of toner image receiving layer. The plasticizing agent may be utilized for the purpose of optimizing competence to run (improvement running ability due to a reduction in frictional force), mproving offset at a fixing region (separation of a toner and a toner layer to a fixing member), controlling a curling balance, and adjusting static build-up (formation of an electrostatic toner image).

-Coloring Agent-

Preferred examples of coloring agent include, but not limited to, fluorescent brightening agents, white pigments, colored pigments, dye, etc.

Various fluorescent brightening agents conventionally known in the art can be used without any particular restriction as long as they have absorptive power in near-ultraviolet region and generate fluorescence in a wavelength band from 400 to 500 nm. Specifically, compounds disclosed in, for example, "The Chemistry of Synthetic Dyes" by K. Veen Ratarman, Vol. V, Chapter 8, may be used for the fluorescent brightening agent Further, available examples of fluorescent brightening agent may include synthesized agents such as stilbene compounds, coumarin compounds, biphenyl compounds, benzoxazoline compounds, naphthalmide compounds, pyrazoline compounds, carbostyryl compounds, etc. and commercially available agents such as White Fulfa-PSN, White AFufa-PHR, White Fulfa-HCS, White Fulfa-PCS, White Fulfa-B (manufactured by Sumitomo Chemical Co., Ltd.) and UVITEX-OB (manufactured by Chiba-Geigy Ltd.).

Preferable example of white pigment include, but not limited to, those conventionally known in the art, namely inorganic pigments such as titanium oxides, calcium carbonates, etc.

Preferable examples of colored pigment include, but not limited to, various pigments such as disclosed in, for example, Japanese Unexamined Patent Publication No. 63-44653, azo pigments, polycyclic pigments, condensation polycyclic pigments, lake pigments, lake pigments, inorganic pigments, carbon black, etc. Examples of the azo pigments includes azolake such as carmine 6B, red 2B, etc.; insoluble azo pigments such as monoazo yellow, diazo yellow, pyrazolon orange, Balkan orange, etc.; condensed azo pigments such as chromophthal yellow and chromophthal red, and the like. Examples of the polycyclic pigments include phthalocyanine pigments such as copper phthalocyanine blue, copper phthalocyanine green, etc. Examples of the condensation polycyclic pigments include dioxazine pigments such as dioxazine violet, etc.; isoindolynone pigments such as indolynone yellow, etc.; slen pigments, perylene pigments, perynon pigments, thioindigo pigments and the like. Examples of the lake pigments include malachite green, rhodamine B, rhodamine G, Victoria blue B, etc. Examples of the inorganic pigments include oxides such as titanium dioxides, colcothar, etc.; sulfate such as precipitated barium sulfate, etc.; carbonates such as precipitated calcium carbonate, etc.; silicate such as hydrated silicate, anhydrous silicate, etc.; metal powder such as aluminum powder, bronze powder, blue powder, chrome yellow, iron blue; and the like. These colored pigments may be used individually or in any combination of two or more.

The dye can be selected from, but not limited to, those conventionally known in the art such as anthraquinone compounds and azo compounds. Examples of water-insoluble dye include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20, C.I.Vat blue 35, etc.; dispersive dyes such as C.I. disperse violet 1, C.I. disperse violet 4, C.I. disperse violet 10, C.I. disperse blue 3, C.I. disperse blue 7, C.I. disperse blue 58, etc.; and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, etc. Colored couplers used in silver salt photography can be preferably utilized.

The coloring agent content is preferably in a range from 0.1 to 8 $g/m^2$, and more preferably in a range from 0.5 to 5 $g/m^2$, with respect to the toner image receiving layer. If the coloring agent content is less than 0.1 $g/m^2$, the toner image receiving layer has a light transmittance too high. On the other hand, if the coloring agent content is beyond 8 $g/m^2$, the toner image receiving layer is possibly apt to become poor in tractability concerning adhesion resistance and cracks. In particular among the coloring agents, the pigment content is preferably less than 40% by mass, more preferably less than 30% by mass, and most preferably less than 20% by mass, with respect to the mass of the thermoplastic resin in the toner image receiving layer.

-Filler-

Preferable examples of filler include various fillers, organic or inorganic, and those conventionally known in the art as stiffeners, loading materials and reinforcing materials for binder resins. The filler can be selected consulting "Handbook: Rubber Plastics Composing Chemicals" (Rubber Digest Ltd.), "New Edition: Plastic Composing Chemicals: Fundamentals and Applications" (Taiseisha), and "Filler Handbook" (Taiseisha). Preferable examples of inorganic fillers and inorganic pigments available for the filler include silica, alumina, titanium dioxides, zinc oxides, zirconium oxides, mica-like ferric oxides, zinc white, lead oxides, cobalt oxides, strontium chromate, molybdenum pigments, smectite, magnesium oxides, calcium oxides, calcium carbonates, mullite, etc. Among them, silica and alumina are especially preferable. These fillers may be used individually or in combination of two or more. It is desirable for the filler to have smaller particle sizes. If the filler particles are too large in size, the toner image receiving layer is apt to have a coarse surface.

There are two types of silica available for the filler, i.e. spherical silica and amorphous silica. These silica can be synthesized in either a wet process, a dry process or an aerogel process. It is allowed to treat surfaces of hydrophobic silica particles with a trimethylsilyl group or silicon. In this instance, it is preferred to use colloidal silica particles that are desirably porous.

There are two types of alumina available for the filler, i.e. anhydrous alumina and alumina hydrate. The anhydrous alumina may be of a crystal form of $\alpha$, $\beta$, $\gamma$, $\delta$, $\zeta$, $\eta$, $\theta$, $\kappa$, $\rho$ or $\chi$. The alumina hydrate is more preferable rather than the anhydrous alumina. There are two types of alumina hydrate, namely monohydrate such as pseudoboehmite, boehmite and diaspore, and trihydrate such as gibbsite and bayerite. The alumina particles are preferably porous. The alumina hydrate can be synthesized in either a sol-gel process in which alumina hydrate is precipitated by adding ammonia in a solution of aluminium salt or a hydrolysis process in which an alkali aluminate is hydrolyzed. The anhydrous alumina can be derived by heating and dehydrating an alumina hydrate.

The filler content is preferred to be between 5 to 2000 parts by mass with respect to 100 parts by dry mass of a binder in the toner image receiving layer.

-Cross-linking Agent-

A cross-linking agent may be added in order to adjust storage stability and thermoplasticity of the toner image receiving layer. Examples of compounds available for the cross-linking agent include those having two or more reactive groups such as an epoxy group, an isocyanate group, an aldehydo group, an active halogen group, an active methylene group, an acetylene group or conventionally known reactive group, in one molecule. Aside from these compounds, available compounds are those having two or more groups capable of forming a bond through an ionic bond, a hydrogen bond, a coordinate bond, etc. Further examples of cross-linking agent include compounds conventionally known as a coupling agent, a hardening agent, a polymerizing agent, a polymerization promoter, a coagulating agent, a film forming ingredient, an auxiliary film forming ingredient and the like for resins. Examples of the coupling agent include chlorosilane, vinylsilane, epoxysilane, aminosilane, alkoxyaluminum chelate, titanate coupling agents and, additionally, include those disclosed in "Handbook: Rubber Plastics Compounding Chemicals" (Rubber Digest Ltd.).

-Electrostatic Charge Control Agent-

It is preferred for the toner image receiving layer to contain an electrostatic charge control agent for the purpose of controlling toner transfer and toner adhesion. Preferred examples of the electrostatic charge adjusting agent include, but not limited to, various types of electrostatic charge control agents conventionally known in the art, namely surface-active agents such as cation surface-active agents, anion surface-active agents, amphoteric surface-active agents, nonion surface-active agents, etc. and, aside from those, polyelectrolytes, electroconductive metal oxides and the like. Specific examples of electrostatic charge control agent include cation antistatic agent such as quaternary ammonium salts, polyamine derivatives, cation-modified polymethylmethacrylate, cation-modified polystyrene, etc.; anionic antistatic agents such as alkylphosphate, anion polymers, etc.; and nonionic antistatic agents such as fatty ester, polyethylene oxides, etc. In the case where a toner is charged with negative electricity, the electrostatic charge control agent that is contained in the tone image receiving layer is preferably of a catyon type or of a nonion type.

Examples of the electroconductive metal oxide include ZnO, $TiO_2$, $SnO_2$, $Al_2O_3$, $In_2O_3$, $SiO_2$, MgO, BaO, $MoO_3$, etc. These electroconductive metal oxides may be used individually or in combination of two or more thereof. The respective metal oxide may further contain, or may be doped with, hetero elements such as, for example, Al or In for ZnO, Nb or Ta for $TiO_2$, Sb, Nb or halogen for $SnO_2$.

-Other Additives-

The toner image receiving layer may contain other additives for the purpose of improving stability of image formation thereon and stability of the image recording layer itself. Examples of the other additives include antioxidants, anti-aging agents, anti-gradation agents, anti-ozonants, ultraviolet absorption agents, metal complexes, light stabilizers, antiseptic agents, fungicide, etc. which are well known in the art.

Specifically, examples of the antioxidants include, but not limited to, chroman compounds, coumaran compounds, phenolic compounds such as hindered phenol, hydroquinone derivatives, hindered amine derivatives, spiroindan compounds, etc. The antioxidants that are disclosed in, for example, Japanese Unexamined Patent Publication No. 61(1986)-159644 can be use.

Examples of the anti-aging agents include, but not limited to, those disclosed in "Handbook: Rubber-Plastics Compounding Chemicals 2$^{nd}$ Revised Edition" (1993, Rubber Digest Ltd.), pages 76~121.

Examples of the ultraviolet absorption agents include, but not limited to, benzotriazole compounds such as disclosed in U.S. Pat. No. 3,533,794, 4-thiazolidine compounds such as disclosed in U.S. Pat. No. 3,352,681, benzophenone compounds such as disclosed in Japanese Unexamined Patent Publication No. 46(1971)-2784, and ultraviolet absorption polymers such as disclosed in Japanese Unexamined Patent Publication No. 62(1987)-260152.

Examples of the metal complexes include, but not limited to, those disclosed in, for example, U.S. Pat. Nos. 4,241,155, 4,245,018 and 4,254,195, Japanese Unexamined Patent Publication Nos. 61(1986)-88256, 62(1987)-174741, 63(1988)-199248, 1(1989)-75568 and 1(1989)-74272. In addition, the ultraviolet absorption agents and the light stabilizes disclosed in "Handbook: Rubber Plastics Composing Chemicals 2$^{nd}$ Revised Edition" (1993, Rubber Digest Ltd.), pages 122~137 are preferably used.

Photographic additives conventionally well known in the photographic art can be added to the toner image receiving layer as appropriate. Examples of the photographic additives include those disclosed in Research Disclosure (RD) Nos. 17643 (December 1978), 18716 (November 1979) and 307105 (November 1989). Pages on which these additives appear are shown in tabular form below.

| | Additive | | |
|---|---|---|---|
| | RD No. 17643 | RD No. 18716 | RD No. 307105 |
| Brightener | 24 | 648R | 868 |
| Stabilizer | 24-25 | 649R | 868-870 |
| Light Absorbent (UV Absorbent) | 25-26 | 649R | 873 |
| Color Dye Image Stabilizer | 25 | 650R | 872 |
| Film Hardener | 26 | 651L | 874-875 |
| Binder | 26 | 651L | 873-874 |
| Unstiffening Agent/Lubricant | 27 | 650R | 876 |
| Coating Auxiliary Agent (Surface-active Agent) | 26-27 | 650R | 875-876 |
| Antistatic Agent | 27 | 650R | 976-977 |
| Matting Agent | | | 878-879 |

I is preferred for the toner image receiving layer to have a dried spread desirably in a range from 1 to 20 g/cm$^2$ and more desirably in a range from 4 to 15 g/cm$^2$ and further to have a thickness desirably, but not limited to, greater than ½ of toner particle size and more desirably one to three times of toner particle size. More specifically, the thickness of the toner image receiving layer is in a range desirably from 1 to 50 μm, more desirably from 1 to 30 μm, further more desirably from 2 to 20 μm, and most desirably from 5 to 150 μm.

[Solid State Properties of Toner Image Receiving Layer]

The following description will be directed to solid state properties of the toner image receiving layer. It is preferred for the toner image receiving layer to have a 180 degree exfoliation strength less than 0.1 N/25 mm, and more preferably less than 0.041 N/25 mm, at a fixing temperature of a fixing member. The 180 degree exfoliation strength is found from a measurement regarding a surface material of the fixing member by the method defined by JIS K6887. It is preferred for the toner image receiving layer to have a high degree of whiteness, specifically greater than 85% when estimated by the method defined by JIS P8123. More specifically, when specifying the degree of whiteness in terms of CIE 1976 (L*a*b*) color space, it is preferred for the toner image receiving layer to have an L* value desirably greater than 80, more desirably greater than 85 and most desirably greater than 90. The toner image receiving layer has a white tincture that is preferred as neutral as possible and represented by a value of $(a^*)^2+(b^*)^2$ desirably less than 50, more desirably less than 18 and most desirably less than 5, in terms of CIE 1976 (L*a*b*) color space.

It is further preferred for the toner image receiving layer to have a spectral reflection coefficient higher than 85% in a wavelength range from 440 to 640 nm and a difference between a peak and a bottom spectral reflection coefficient desirably less than 5% in the same wavelength range. Further preferably, the toner image receiving layer has a spectral reflection coefficient desirably higher than 85% in a wavelength range from 400 to 700 nm and a difference between a peak and a bottom spectral reflection coefficient desirably less than 5% in the same wavelength range.

It is preferred for the toner image receiving layer to have a high glossiness after image formation, specifically, a 45 degree glossiness desirably higher than 60, more desirably higher than 75, and most preferably higher than 90, over a range from a white state (which refers to a state where no toner is applied to the toner image receiving layer) to a black state (which refers to a state where toner is applied to the image recording layer at the maximum density). However, the peak of 45 degree glossiness is desirably less than 110. If the 45 degree glossiness is beyond 110, the toner image receiving layer has a metallic luster surface which leads to undesirable image quality. The glossiness can be estimated by the method defined by JIS Z8741.

It is preferred for the toner image receiving layer to have a high degree of smoothness after fixation desirably less than 3 μm, more desirably less than 1 μm, and most desirably less than 0.5 μm, in terms of arithmetic average roughness (Ra) over a range from the white state to the black state. The arithmetic average roughness (Ra) can be estimated by the method defined by JIS B0601, B0651 or B0652.

It is further preferred for the toner image receiving layer to satisfy at least one, desirably tow or more, and more desirably all, of the following solid state properties (1) to (6):

(1) Melting temperature (Tm):

Desirably higher than 30° C., but within +20° C. from a melting temperature of a toner (2) Temperature at which the toner image receiving layer attains viscosity of $1\times10^5$ cp:

Desirably higher than 40° C. but lower than that of toner (3) Elastic modulus (G) at a fixing temperature of the toner image receiving layer:

Desirably $1\times10^2$~$1\times10^5$ Pa in terms of storage modulus (G') and $1\times10^2$~$1\times10^5$ Pa in term of loss modulus (G")

(4) Loss tangent (G"/G') at a fixing temperature of the toner image receiving layer which refers to a ration of the loss modulus (G") relative to the storage modulus (G')):

Desirably 0.01~10

(5) Storage modulus (G') at a fixing temperature of the toner image receiving layer with respect to storage modulus (G') at a fixing temperature of toner Desirably in a range from −50 Pa to +2500 Pa from the storage modulus (G') at a fixing temperature of toner (6) Angle of inclination of molten toner on the toner image receiving layer:

Desirably less than 50° and more desirably less than 40°.

It is preferred that the toner image receiving layer satisfies the solid state properties disclosed in, for example, Japanese Patent Publication 2788358, Japanese Unexamined Patent Publication Nos. 7(1995)-248637, 8)1996)-305067 and 10(1998)-23889.

It is preferred for the toner image receiving layer to have a surface electrical resistivity desirably in a range from $1\times10^6$ to $1\times10^{15}$ Ω/cm$^2$ under at a temperature of 25° C. and a relative humidity of 65%. If the lower surface electrical resistivity of $1\times10^6$ Ω/cm$^2$ is exceeded, this indicates that an insufficient amount of toner is transferred to the toner image receiving layer, then a toner image is apt to diminish in density. On the other hand, if the upper surface electrical resistivity of $1\times10^{15}$ Ω/cm$^2$ is exceeded, electrostatic charges generating during image transfer is too much to transfer a sufficient amount of toner to the toner image receiving layer so as thereby to lead to an insufficient density of toner image and generation of electrostatic that causes easy adhesion of dust to an elctrophotographic medium during handling the electrophotographic medium. In addition, if the toner image receiving layer that does not satisfy the requirement of surface electrical resistivity causes the electrophotographic medium to be susceptible to misfeeding, double feeding, generation of discharge prints and an occurrence of fractional absence of toner transfer. In this instance, the surface electrical resistivity can be found by measuring a surface electrical resistivity of a sample at a temperature of 20° C. and a relative humidity of 65% by the method defined by JIS K 6911 using a resistivity meter, for example, R8340 manufactured by Advantest Co., Ltd., after a lapse of one minute from impression of a voltage of 100V on the sample subsequently to controlling damp under the same temperature and humidity condition for 8 hours.

[Other Layers]

As was previously mentioned, the electrophotographic image recording medium or paper may be provided with other layers such as, for example, a surface protective layer, a back layer, an adhesiveness improvement layer, an intermediate layer, an under coating layer, a cushioning layer, an electrostatic charge control (antistatic) layer, a reflection layer, a color tincture adjusting layer, a storage stability improvement layer, an anti-adhesion layer, an anti-curling layer, a smoothing layer, etc. These layers may be provided individually or in any combination of two or more.

-Surface Protective Layer-

The surface protective layer is formed on a surface of the electrophotographic image recording paper for the purpose of surface protection, improvement of storage stability, handling adaptability and pass-through ability to pass through ectrophotographic equipments, creation of writing adaptability and anti-offset ability. The protection layer may be single-layered or multi-layered. Although various types of thermoplastic resin binders or thermosetting resin binders can be blended in the surface protective layer, it is preferred to use the same type of binder resin as used in the toner image receiving layer. However, in this instance, the binder resin of the surface protective layer is not always necessarily the same in dynamic and electrostatic characteristics as those of the binder resin of the toner image receiving layer and can be optimized in dynamic and electrostatic characteristics appropriately. The surface protective layer may be further blended with various additives that are allowed to be blended in the toner image receiving layer such as, in particular, a matting agent or the like together with the releasing agent used in the electrophotographic image recording medium previously described. The matting agent may be selected from those conventionally known in the art. It is preferred for an outermost surface layer (e.g. a surface protective payer when it is formed) of the electrophotoelectric image recording paper to have better compatibility with a toner in light of fixing performance. Specifically, it is preferred for the outermost surface layer to have a contact angle with a molten toner in a range from 0 to 40°.

-Back Layer-

The back layer is formed preferably on a surface opposite to the toner image receiving layer of the base support for the purpose of creation of back surface printing adaptability and improvement of back surface printing quality, curling balance and pass-though ability to pass though electro-photographic equipments of the electrophotographic image recording paper. Though the back layer is not always bound by color, it is preferred for the back layer to be white in the case where the electrophotographic image recording paper is of two-sided. The back layer has a degree of whiteness and a spectral reflecting coefficient both higher than 85% similarly to the front surface. In order to improve both-side printing adaptability, the back layer may be the same in structure as that on the toner image receiving layer. Further, the back layer may be blended with the various additives described above, appropriately such as a matting agent and an electrostatic charge control agent In the case of using a roller lubricant oil for fixing rollers in order to prevent an occurrence of offset during fixation, the back layer may be of an oleophic type. The back layer may be single-layered or multi-layered inasmuch as having a thickness in a desirable range from 0.1 to 10 μm under normal conditions.

-Adhesion Improvement Layer and Others-

The electrophotogreaphic image recording paper is preferably provided with an adhesiveness improvement layer for the purpose of improving adhesiveness between the toner image receiving layer and the base support. The adhesiveness improvement layer may be blended with various additives previously described, desirably such as a cross-linking agent. Further, it is preferred for the electrophotogreaphic image recording paper to be provided with a cushioning layer between the adhesiveness improvement layer and the toner image receiving layer for the purpose of enhancing toner acceptability.

-Intermediate Layer-

The electrophotogreaphic image recording paper may be provided with an intermediate layer between the base support and the adhesiveness improvement layer, between the adhesiveness improvement layer and the cushioning layer, between the cushioning layer and the toner image receiving layer, and/or between the toner image receiving layer and the storage stability improvement layer. The electrophotogreaphic image recording paper may have a thickness desirably in, but not limited to, a range from 50 to 550 μm and more desirably in a range from 100 to 350 μm.

<Toner>

In the use of the electrophotographic image recording paper for printing or copying, a toner is accepted to the toner image receiving layer. The toner consists of at least a binding resin and a coloring agent, and, if needed, a releasing agent and other components.

-Binding Resin for Toner-

Preferable examples of binding resin include, but not limited to, those most commonly used for toners, namely for example: styrene such as styrene, parachlorstyrene, etc.; vinyl ester such as vinyl naphthalene, vinyl chloride, vinyl bromide, vinyl fluoride, vinyl acetate, vinyl propionate, vinyl benzoate, vinyl butte, etc.; methylene aliphatic carboxylate ester such as methyl acrylate, ethyl acrylate, n-butyl acrylate, isobutyl acrylate, dodecyl acrylate, n-octyl acrylate, 2-chlorethyl acrylate, phenyl acrylate, methyl α-chloracaylate, methyl methacrylate, ethyl methacrylate, butyl methacrylate, etc; vinyl nitrile such as vinyl methyl ether, vinyl ethyl ether, vinyl isobutyl ether, etc; N-vinyl compounds such as N-vinyl pyrrole, N-vinyl carbazole, N-vinyl indole, N-vinyl pyrrolidone, etc.; homopolymers or copolymers of vinyl monomers of vinyl carbonate such as methacrylate, acrylic acids, cinnamic acids, etc.; and various types of polyester; which may be used in combination of various type of waxes. Among them, the same types of resins as used for the toner image receiving layer are especially preferred.

-Coloring Agent for Toner-

Preferable examples of coloring agent include, but not limited to, those most commonly used for toners, namely: various pigments such as carbon black, chrome yellow, Hansa yellow, benzidine yellow, slen yellow, quinoline yellow, permanent orange GTR, pyrazolone orange, vulcan orange, watchung red, permanent red, brilliant carmine 3B, brilliant carmine 6B, deipon oil red, pyrazolone red, resole red, rhodamine B lake, lake red C, rose bengal, aniline blue, ultramarine blue, carco oil blue, methylene blue chloride, phthalocyanine blue, phthalocyanine green, malachite green oxalate, etc.; and various dye such as acridine dyes, xanthene dyes, azoic dyes, benzoquinone dyes, azine dyes, anthraquinone dyes, thioindigo dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, xanthene dyes, etc. These pigments or dyes may be used individually or in any combination of two or more thereof. It is preferred for the toner to contain the coloring agent desirably in a range from 2 to 8% by mass. If the content of coloring agent is less than 2% by mass, the toner is apt to loses tinctorial power and, if it is beyond 8% by mass, the toner diminishes transparency.

-Releasing Agent for Toner-

Preferable examples of releasing agent include, but not limited to, those most commonly used for toners such as, in particular, higher crystalline polyethylene waxes with a comparatively low molecular weight, Fischer-Tropsch waxes, amide waxes, polar waxes containing nitrogen such as a compound having an urethane bond. It is preferred for the polyethylene waxes to have molecular weights desirably less than 1000, and more desirably in a range from 300 to 1000. The urethane compound (compound having urethane bonds) is especially preferred because it keeps itself in a solid state due to coagulation power of its polar group even though it has only a small molecular weight and can have a melting temperature set higher with respect to a low molecular weight. A preferable range of molecular weight is from 300 to 1000. While examples of the raw material for the compound include a combination of a diisocyanate compound and monoalcohol, a combination of monoisocyanate and monoalcohol, a combination of dialcohol and monoisocyanate, a combination of trialcohol and monoisocyanate, a combination of triisocyanate and monoalcohol, etc., it is preferred in order to keep the compound from having a high molecular weight to select combinations of a compound of multifunctional group and a compound of monofunctional group and is important for the compound to have quantitatively equivalent functional groups.

Example of monoisocyanate compounds include dodecyl isocyanate, phenyl isocyanate, derivatives of phenyl isocyanate, naphthyl isocyanate, hexyl isocyanate, benzyl isocyanate, butyl isocyanate, aryl isocyanate, etc. Example of diisocyanate compounds include tolylene diisocyanate, 4,4'diphenyl methane diisocyanate, toluene diisocyanate, 1,3-phenylene diisocyanate, hexamethylene diisocyanate, 4-methyl-m-phenylene diisocyanate, isophorone diisocyanate, etc. Example of mono-alcohol include methanol, ethanol, propanol, butanol, pentanol, hexanol, heptanol, etc. Example of dialcohol include various glycol such as ethylene glycol, diethylene glycol, triethylene glycol, trimethylene glycol, etc. Example of trialcohol include trimethylolpropane, triethylolpropane, trimethanolethane, etc.

The respective urethane compounds may be mixed into a toner together with a resin and/or a coloring agent like ordinary releasing agents so as to furnish a pulverized mixed toner. When using the urethane compound as a releasing agent for a toner prepared through an emulsion polymerization-coagulation melting process, the urethane compound releasing agent is employed in the form of a particle dispersed liquid prepared by dispersing the urethane compound in water together with a polyelectrolyte such as an ionic surface-active agent, a polymer acid or a polymer base, heating it to a temperature higher than its melting point and then pulverizing it into particulates of less than 1 μm with strong shearing force by means of a homogenizer or a pressure discharge dispersing machine. The urethane compound particle dispersed liquid is be blended in the toner together with a resin particle dispersion liquid and/or a coloring agent particle dispersed liquid.

-Other Components for Toner-

The toner may be blended with other components such as an internal additive, an electrostatic charge control agent, inorganic particulates, etc. Examples of internal additive include various magnetic substances, namely: metals such as ferrite, magnetite, reduced iron, cobalt, nickel, manganese, etc.; alloys of these metals; compounds containing these metals; etc. Examples of the electrostatic charge control agent include dye comprising a quaternary ammonium salt compound, a nigrosin compound, a complex of aluminum, iron or chrome; and various triphenylmethane pigments; etc. which are ordinarily utilized as antistatic agent. In light of controlling ionic strength that affects stability of the toner during coagulation and melting and reducing wastewater pollution, it is preferred to employ electrostatic charge control agents that are hardly dissolved in water.

Examples of the inorganic particulate include conventional additives that are know as external additives ordinarily applied to surfaces of toner particles such as silica, alumina, titania, calcium carbonate, magnesium carbonate, tricalcium phosphate, etc. It is preferred to use these inorganic particles in the form of a dispersion with an ionic surface-active agent, polymer acid or a polymer base.

A surface-active agent may be additionally used for the purpose of emulsification polymerization, seed polymerization, dispersion of pigment, dispersion of resin particles, dispersion of a releasing agent, coagulation and stabilization of them. It is effective to use an anion surface-active agent such as sulfate salt surface-active agents, sulfonate surface-active agents, phosphate surface-active agents or soap surface-active agents or the like; a cationic surface-active agent such as amine salt surface-active agents or quaternary ammonium salt surface-active agents or the like; or a nonionic surface-active agent such as polyethylene glycol surface-active agents, surface-active agents added with an alkylphenol ethylene oxide, polyhydric alcohol surface-active agents or the like. It is possible to use popular dispersing machines such as a rotary shearing type of homogenizer, a ball mill using a shearing medium, a sand mill, a dyno mill or the like in order to prepare a dispersion of the surface-active agent.

An external additive may be further added to the toner. Examples of the external additive include inorganic particles such as particles of $SiO_2$, $TiO_2$, $Al_2O_3$, CuO, ZnO, $SnO_2$, $Fe_2O_3$, MgO, BaO, CaO, $K_2O$, $NaO_2$, $ZrO_2$, $CaO{\cdot}SiO_2$, $K_2O{\cdot}(TiO_2)_n$, $Al_2O_3{\cdot}2SiO_2$, $CaCO_3$, $MgCO_3$, $BaSO_4$, $MgSO_4$, or the like and organic particles such as powder of fatty acid, a derivative of fatty acid or metallic alts of them; powder of a fluorocarbon resin, a polyethylene resin, an acryl resin or the like. It is preferred for these particles to have average particle sizes desirably in a range from 0.01 to 5 μm, and more desirably in a range from 0.1 to 2 μm.

Although various processes may be used to produce the toner without any particular restriction, it is preferred to employ a process comprising the following processes (i) to (iii):

(i) A process of coagulating resin particles in a resin particle dispersion liquid so as thereby to prepare a coagulated resin particle dispersion liquid;

(ii) A process of mixing a dispersion liquid of particulates with the coagulated resin particle dispersion liquid to cause the particulates to adhere to the coagulated resin particles; and (iii) A process of heating and melting the particulate-adhered coagulated particles to form toner particles.

-Solid State Properties of Toner-

The volumetric average particle size of toner particles is preferably in a range from 0.5 to 10 μm. If the lower volumetric average particle size of 0.5 μm is exceeded, it affects tractability of the toner (facility for replenishment, cleaning adaptability and flowability) and particle productivity. On the other hand, if the upper volumetric average particle size of 10 μm is exceeded, it affects image quality and resolution due to graininess and transferability. It is preferred for the toner satisfying the requirement of volumetric average particle size to have a distribution index of volumetric average particle size (GSDv) equal to or less than 1.3. It is further preferred for the toner to have a distribution ratio of volumetric average particle size distribution index relative to number average particle size distribution index (GSDv/GSDn) equal to or greater than 0.9. In addition, it is preferred for the toner satisfying the requirement of volumetric average particle size to have an average profile factor expressed by the following equation in a range from 1.00 to 1.50.

$$\text{Profile factor}=(\pi\times L^2)/(4\times S)$$

where L is representative of a greatest size of toner particles and S is representative of a projected area of toner particles.

When satisfying the requirements as set forth above, the toner has an positive effect on image quality, in particular graininess and resolution of an image, significantly reduces or prevents fractional absence of toner and/or blurred toner image occurring concurrent with toner image transfer, and is hardly apt to have an adverse effect on tractability of the toner even though the toner has an average particle size not so small.

In this instance, it is preferred for the toner itself to have a storage modulus (G') (that is measured with an angular frequency of 10 rad/sec) at a temperature of 150° C. in a range from $1\times10^2$ to $1\times10^5$ Pa in light of improving image quality and offset resistance in a fixing process.

<Heat-Sensitive Recording Paper>

The heat-sensitive recording paper comprises, for example, at least a thermal color development layer formed as an image recording layer on the base support of the present invention and is suitably used with a thermo-autochrome method (AT method) by which an image is formed by repeating heating with a thermal head and fixation with ultraviolet radiation.

<Sublimation Transfer Printing Paper>

The sublimation transfer recording paper comprises, for example, at least an ink layer containing thermal diffusion dye (sublimation dye) formed as an image recording layer on the base support of the present invention and is suitably with a sublimation transfer method by which an image is formed by selectively heating the ink layer with a thermal head to transfer the thermal diffusion dye to the sublimation transfer recording paper from the ink layer.

<Thermal Transfer Printing Paper>

The thermal transfer printing paper comprises, for example, at least a hot-melt ink layer formed as an image recording layer on the base support of the present invention and is suitably used with a melting transfer method by which an image is formed by selectively heating the hot-melt ink layer with a thermal head to transfer the molten ink to the thermal transfer printing paper.

<Silver Salt Photographic Paper>

The silver salt photographic paper comprises, for example, at least Y, M and C image forming layers formed as an image recording layer on the base support of the present invention and is suitably used with a silver salt photographic method by which an image is formed by performing color development, breaching and fixation, washing and drying while an exposed silver salt photographic paper travels through processing tanks.

<Ink-Jet Printing Paper>

The ink-jet printing paper comprises, for example, a color material receptive layer, that is capable of receiving a color material such as liquid inks, namely an aqueous ink (comprising dye or pigment as a color material) and an oil-based ink, and solid inks that are solid at a normal temperature and is melted and liquefied upon printing, formed as an image recording layer on the base support of the present invention.

<Printing Paper>

The base support for an image recording medium is suitably available as printing paper and, in this case, is preferred to have a high mechanical strength in light of that ink is applied to the printing paper by a printing machine. In the case where a base paper is used for the base support as the printing paper, it is preferred for the base paper to contain a filler, a softening agent, papermaking internal dopant auxiliaries, etc. Examples of the filler include generally available fillers, namely inorganic fillers such as clay, burnt clay, diatom earth, talc, kaolin, burnt kaolin, delami kaolin, calcium carbonate heavy, precipitated calcium carbonate light, magnesium carbonate, barium carbonate, titanium dioxides, zinc oxides, silicon dioxides, amorphous silica, aluminium hydroxides, calcium hydroxides, magnesium hydroxides, zinc hydroxides, etc. and organic fillers such as urea-formalin resins, polystyrene resins, phenol resins, hollow particulates, etc. These fillers may be used independently or in any combination of two or more thereof.

Examples of the internal dopant auxiliaries include yield ratio improvers, freeness improvers, paper strength improvers, internal sizing agents, nonionic, cationic or anionic, which are conventionally used in the art. More specifically, there are a variety of internal dopant auxiliaries, namely: basic aluminium compounds such as aluminum sulfate, aluminium chloride, soda aluminate, basic aluminium chloride, basic aluminium polyhydrated, etc.; polyvalent metal compounds such as ferrous sulfate, ferric sulfate, etc.; compounds of water-soluble polymers such as starch, processed starch, polyacrylamide, urea resins, melamine resins, epoxy resins, polyamide resins, polyamine resins, polyamine, polyethylene imine, vegetable gum, polyvinyl alcohol, latex, polyethylene oxides, etc., disperses of hydrophilic cross-linked polymer particles, derivatives or denatured products of them; and the like. The respective substances have some functions of papermaking dopant auxiliaries concurrently. Remarkably effective examples of the internal sizing agent include alkylketene dimmer compounds, alkenylsucinic anhydride compounds, styrene-acryl compounds, higher fatty acid compounds, petroleum resin sizing agents and rosin sizing agents.

The base support may further contain one or more internal additives for paper making such as dye, a fluorescent brightening agent, a pH adjuster, a defoaming agent, a pitch controller, a slime controller, etc., as appropriate.

The printing paper described above is suitably used especially in offset lithography, and available as relief printing paper, photogravure printing paper and electrophotophotographic printing paper.

As described above, because the image recording medium of the present invention comprises a base support for image recording medium striking a balance between high flatness and superb stiffness on a high level and an image recording layer formed on the base support, the image recording medium can record high quality images thereon and create superb glossiness and superb smoothness, so as to be suitably used as a variety of image recording paper including electrophotographic paper, heat-sensitive printing paper, sublimation transfer printing paper, heat-transfer printing paper, silver salt photographic paper and ink-jet printing paper.

The following description will be directed to a method of manufacturing the base support and the image recording medium with the same used therein of the present invention by way of example.

PRACTICAL EXAMPLE PE1

-Preparation of Base Support-

First of all, paper pulp for the base support was prepared by beating bleached broad leaf tree kraft pulp (LBKP) to a freeness of 300 ml in Canadian Standard Freeness (C.S.F.) so as to adjust an average fiber length to 0.61 mm with a disk refiner and then adding additives in the following proportions with respect to a total mass of the paper pulp.

| Additives | Proportion (%) |
|---|---|
| Cation Starch | 1.2 |
| Alkylketene Dimer (AKD) | 0.5 |
| Anion Polyacrylamide | 0.2 |
| Polyamide Polyamine Epichlorohydrin | 0.3 |

Note)
Alkyl of AKD is derived from a fatty acid primarily composed of behenic acid.

The paper pulp thus prepared was processed to provide 150 g/m$^2$ by basic weight of base support using a fourdrinier paper machine. The base paper was coated with a dispersion liquid of epoxydized fatty acid amide (a solid content: 8% by mass) expressed by the following structural formula (1) as a softening agent on a surface on which the toner image receiving layer is to be formed at a spread of 4 g/m$^2$ by means of a gate roll coater at the midpoint of a drying zone and then dried.

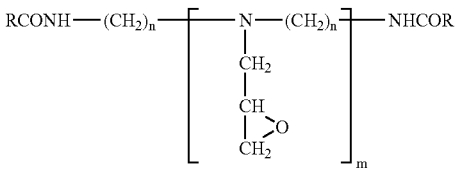

where R represents $C_{21}H_{41}$ and n and m are integers 2, respectively.

In the final stage of the papermaking process, the base paper was subjected to soft calendering for the surface where the toner image receiving layer is to be formed and then further to shoe calendering so as thereby to prove base paper (PE 1) having a thickness of 150 μm and a density of 1.0 g/cm$^3$. The calendering was performed by keeping the base paper in contact with the soft calendering metal roller at a surface temperature of 250° C. and the shoe calendering metal roller at a surface temperature of 210° C. The base support was rated in penetration depth of an unstiffening agent, internal bond strength, flatness and stiffness in such a way as described below. The result is shown in Table I.

<Penetration Depth of Unstiffening Agent>

In order to determine the depth of penetration of a coated unstiffening agent, 10 samples were collected from the subsurface layer of the base paper (a layer leading to ⅓ of depth from a front surface on which the unstiffening agent was coated or on which a toner image receiving layer is to be formed) at random depths in a cross-section within 50 μm from the front surface in this example. The unstiffening agent was extracted from the ten samples with an extraction solvent of n-butanol and reextracting from the same samples with an extraction solvent of chloroform and subsequently analyzed by means of gas chromatography. The penetration depth of unstiffening agent was determined by the greatest one of depths of samples from which the unstiffening agent was extracted.

<Internal Bond Strength>

The subsurface internal bond strength of the base paper was determined by measuring strength of a sample prepared by chipping off the base paper by ⅔ of the thickness from a rear surface (a surface opposite to the front surface on which the unstiffening agent was coated) in conformity with the provision No. 54 of Japan TAPPI. The central internal bond strength of the base paper was determined by measuring strength of a sample prepared by chipping off the base paper by ⅓ of the thickness from both surfaces in conformity with the provision No. 54 of Japan TAPPI.

<Flatness>

The base paper was assessed on flatness in five grades prescribed below through visual observation by 20 inspectors.

[Assessment Grade]

Grade 1: Significant irregularities in flatness are perceived.

Grade 2: Irregularities in flatness are perceived but at a practically controversial level.

Grade 3: Slight irregularities in flatness are perceived but at a practically allowable level.

Grade 4: No deficiency in flatness.

Grade 5: Perfectly no deficiency in flatness.

<Stiffness≦

The base paper was assessed on stiffness (toughness) in five grades prescribed below through visual observation by 20 inspectors.

[Assessment Grade]

Grade 1: Lack of stiffness

Grade 2: Insufficient stiffness to a practically controversial level.

Grade 3: Slightly deficiency in stiffness but at a practically allowable level.

Grade 4: No deficiency in stiffness

Grade 5: Perfectly no deficiency in stiffness

PRACTICAL EXAMPLE PE2

Base support paper of practical example PE2 was prepared in the same manner as the base support of practical example PE1 except that a dispersion liquid of epoxydized fatty acid amide had a solid content of 7% by mass and coated at a spread of 3 g/m$^2$. The base paper was rated in penetration depth of unstiffening agent, internal bond strength, flatness and stiffness in the same way as the base support of example PE1. The result is shown in Table I.

PRACTICAL EXAMPLE PE3

Base support paper of practical example PE3 was prepared in the same manner as the base support of practical example PE1 except that epoxydized fatty acid amide was replaced with a fatty acid diamide salt expressed by the following structural formula (2) where R represents $C_{17}H_{33}$ and a dispersion liquid of fatty acid diamide salt was coated at a spread of 5 g/m$^2$. The base paper was rated in penetration depth of unstiffening agent, internal bond strength, flatness and stiffness in the same way as the base support of example PE1. The result is shown in Table I.

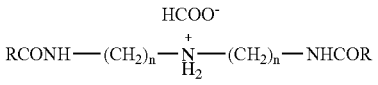

PRACTICAL EXAMPLE PE4

Base support paper of practical example PE4 was prepared in the same manner as the base support of practical example PE1 except that 0.2% by mass of epoxydized fatty acid amide was added as an unstiffening agent in pulp paper and a dispersion liquid of epoxydized fatty acid amide was coated at a spread of 5 g/m$^2$. The base paper was rated in penetration depth of unstiffening agent, internal bond strength, flatness and stiffness in the same way as the base support of example PE1. The result is shown in Table I.

COMPARATIVE EXAMPLE CE1

Base support of comparative examples CE1, CE2 and CE3 were prepared in the same manner as the base support of practical example PE1 except that no unstiffening agent was coated in the case of comparative example PE1, that a dispersion liquid of epoxydized fatty acid amide had a solid content of 2% by mass and was coated at a spread of 3 g/m$^2$ in the case of comparative example CE2, and that no unstiffening agent was coated, and 0.6% by mass of epoxydized fatty acid amide was added as an unstiffening agent in pulp paper in the case of comparative example CE3.

The base papers of comparative examples CE1~CE3 were rated in penetration depth of unstifening agent, internal bond strength, flatness and stiffness in the same way as the base support of practical example PE1. The results are shown in Table I.

TABLE I

| | Unstifening Agent | Penetration Depth (μm) | Internal Bond Strength (mJ) A | B | A/B | Flatness (Grade) | Stiffness (Grade) |
|---|---|---|---|---|---|---|---|
| PE1 | Epoxydized Fatty Acid Amide | 18 | 110 | 190 | 0.58 | 5 | 5 |
| PE2 | Epoxydized Fatty Acid Amide | 12 | 126 | 188 | 0.67 | 4 | 5 |
| PE3 | Fatty Acid Amide Salt | 22 | 102 | 192 | 0.53 | 5 | 5 |
| PE4 | Epoxydized Fatty Acid Amide | 20 | 93 | 168 | 0.55 | 5 | 4 |
| CE1 | None | 0 | 190 | 191 | 0.99 | 2 | 5 |
| CE2 | Epoxydized Fatty Acid Amide | 1 | 158 | 192 | 0.82 | 3 | 5 |
| CE3 | Epoxydized Fatty Acid Amide | 0 | 145 | 143 | 1.0 | 4 | 2 |

It is proved from Table I that the base supports of practical examples PE1~PE4 have internal bond strength ratios A/B less than 0.7 and, inconsequence, strikes a balance between high flatness and superb stiffness on a hive level and, in contrast to the base supports of practical examples, the base support s of comparative examples CE1~CE3 have internal bond strength ratios A/B exceeding 0.7 and, inconsequence, are poor on flatness and stiffness.

PRACTICAL EXAMPLE PE5

A base support comprising a subsurface layer and another layer was prepared for practical example PE 5 by the use of a combination machine. 50 g/m$^2$ by basic weight of base paper for the subsurface layer was milled from pulp paper similar to that for the base support of practical example PE 1 but added with 0.7% by mass of unstiffening agent (epoxydized fatty acid amide) with respect to the pulp by the use of a fourdrinier paper machine. Further, 100 g/m$^2$ by basic weight of base paper for the other layer was milled from the same pulp paper as that for the base support of practical example PE1 by the use of the fourdrinier paper machine. These two base paper were tied together by the combination machine to mill double layer paper for the base support of practical example PE5. In this instance, the subsurface layer and the remaining layer were 47 μm and 103 μm in thickness, respectively, and both 1.0 g/cm$^3$ in density. The base support of practical example PE 5 was rated in internal bond strength, flatness and stiffness in the same way as previously described. The result is shown in Table II.

PRACTICAL EXAMPLE PE6

A double layer base support was prepared for practical example PE 6 by the use of the combination machine. Paper pulp for the subsurface layer of the base support was prepared from the same paper pulp as the paper pulp for the base support of practical example PE 1 except that the bleached broad leaf tree kraft pulp (LBKP) was replaced with a mixture of 80 parts of bleached broad leaf tree kraft pulp (LBKP) and 20 parts of bleached coniferous tree kraft pulp (NBKP), and 50 g/m$^2$ by basic weight of base paper for the subsurface layer was milled from the paper pulp by the use of fourdrinier paper machine. Further, paper pulp for the remaining layer of the base support was prepared from the same paper pulp as the paper pulp for the base support of practical example PE 1 except that the bleached broad leaf tree kraft pulp (LBKP) was replaced with a mixture of 75 parts of bleached broad leaf tree kraft pulp (LBKP) and 25 parts of bleached coniferous tree kraft pulp (NBKP), and 100 g/m$^2$ by basic weight of base paper for the subsurface layer was milled from the paper pulp by the use of fourdrinier paper machine. These two base paper were tied by together by the combination machine to milled double layer paper for the base support of practical example PE 6. In this instance, the subsurface layer and the remaining layer were 50 μm and 100 μm in thickness, respectively, and both 1.0 g/cm$^3$ in density. The base support of practical example PE 6 was rated in internal bond strength, flatness and stiffness in the same way as previously described. The result is shown in Table II.

COMPARATIVE EXAMPLE CE4

A base support comprising a subsurface layer and another layer was prepared for comparative example CE 4 in the same way as the base support of practical example PE 6 except that a subsurface layer was prepared from the same paper pulp as for the base paper of practical example PE6 which comprises a mixture of 75 parts of bleached broad leaf tree kraft pulp (LBKP) and 25 parts of bleached coniferous tree kraft pulp (NBKP) in place of the mixture of 80 parts of bleached broad leaf tree kraft pulp (LBKP) and 20 parts of bleached coniferous tree kraft pulp (NBKP). In this instance, the subsurface layer and the remaining layer were 50 μm and 100 μm in thickness, respectively, and both 1.0 g/cm$^3$ in density. The base support of comparative example CE 4 was rated in internal bond strength, flatness and stiffness in the same way as previously described. The result is shown in Table II.

COMPARATIVE EXAMPLE CE5

A base support comprising a subsurface layer and another layer was prepared for comparative example CE 5 in the same way as the base support of practical example PE 6 except that a subsurface layer was milled from the same paper pulp as for the base paper of practical example PE6 which comprises a mixture of 75 parts of bleached broad leaf tree kraft pulp (LBKP) and 25 parts of bleached coniferous tree kraft pulp (NBKP) in place of the mixture of 80 parts of bleached broad leaf tree kraft pulp (LBKP) and 20 parts of bleached coniferous tree kraft pulp (NBKP) and a remaining layer was milled from the same paper pulp as that of practical example PE1. In this instance, the subsurface layer and the remaining layer were 52 μm and 98 μm in thickness, respectively, and both 1.0 g/cm$^3$ in density. The base support of comparative example CE 5 was rated in internal bond strength, flatness and stiffness in the same way as previously described. The result is shown in Table II.

TABLE II

| | Thickness of Subsurface Layer | Internal Bond Strength (mJ) A | B | A/B | Flatness (Grade) | Stiffness (Grade) |
|---|---|---|---|---|---|---|
| PE5 | 47 | 105 | 190 | 0.55 | 5 | 5 |
| PE6 | 45 | 101 | 230 | 0.44 | 5 | 5 |
| CE4 | 50 | 225 | 232 | 0.98 | 1 | 5 |
| CE5 | 52 | 225 | 189 | 1.19 | 2 | 5 |

It is proved from Table II that the base supports of practical examples PE5 and PE6 have internal bond strength ratios A/B less than 0.7 and, inconsequence, strikes a balance between high flatness and superb stiffness on a hive level and, in contrast to the base supports of practical examples, the base support s of comparative examples CE4 and CE5 have internal bond strength ratios A/B exceeding 0.7 and, inconsequence, are both poor on flatness and stiffness.

PRACTICAL EXAMPLES PE6~PE10 AND COMPARATIVE EXAMPLES 5CE~CE8

-Electrophotographic Imae Recording Medium-

Electrophotographic image recording paper of practical examples PE6~PE10 and comparative examples CE5~CE8 were prepared by the use of the base support paper of practical examples PE1~PE5 and comparative examples CE1~CE4, respectively, by the following manner.

-Titanium Dioxide Dispersion Liquid-

A titanium dioxide dispersion liquid was prepared by dispersing a mixture of 40.0 g of titanium dioxide (Taipek RA-220: trade name of Ishiharasangyo Ltd.), 20 g of polyvinyl alcohol (PVA102: manufactured by Kurare Co., Ltd.) and 58.0 g of ion exchanged water with NBK-2 (manufactured by Nihon Seiki Co., Ltd.) so as to contain 40% by mass of titanium dioxide pigment.

-Coating Liquid of Toner Image Receiving Layer-

A coating liquid for a toner image receiving layer was prepared by making and stirring a mixture solution of 15.5 g of the titanium dioxide dispersion liquid, 15.0 g of carnauba wax dispersion liquid (Serzole 524: manufactured by Chukyo Oils & Fats Co., Ltd.), 100 g of polyester resin water dispersion liquid (solid content: 30% by mass; KZA-7049: manufactured by Unitika Ltd.), 2.0 g of viscosity fortifier (Alcox E30: manufactured by Meisei Chemical Co., Ltd.), 0.5 g of anion surface active agent (AOT) and 80 ml of ion exchanged water so as to have a viscosity of 40 mPa·s and a surface tension of 34 mN/m.

-Coating Liquid of Back Layer-

A coating liquid for a back layer was prepared by making and stirring a mixture solution of 100.0 g of acrylic resin water dispersion liquid (solid part: 30% by mass; Hyros XBH-997L: manufactured by Seiko Chemical Industry Co., Ltd.), 5.0 g of a matting agent (Tekpomar MBX-12: manufactured by Sekisui Chemical Co., Ltd.), 10.0 g of releasing agent (Hidrin D-337: manufactured by Chukyo Oils & Fats Co.), 2.0 g of a viscosity improver (CMC), 0.5 g of an anion surface active agent (AOT) and 80 ml of ion exchanged water so as to have a viscosity of 35 mPa·s and a surface tension of 33 mN/m.

-Coating Toner Image Receiving Layer and Back Layer-

Each of the base support paper of practical examples PE1~PE6 and comparative examples CE1~CE5 was coated with a back layer on the back surface kept in contact to heated roller with a bar coater so that the back layer has a dried mass of 9 g/m$^2$ and then with a toner image receiving layer on the front surface kept in contact to a heated roller with a bar coater so that the toner image receiving layer has a dried mass of 12 g/m$^2$. The toner imager receiving layer contained 5% by mass of pigment with respect to a total mass of the thermoplastic resin. These toner image receiving layer and the back layer were subjected to on-line hot-air drying. Both hot-air flow rate and air temperature were adjusted so as to complete the drying of each layer within two minutes after coating. Especially, the drying temperature was set to a point at which a surface temperature of the coated layer becomes equal to a wet-bulb temperature of the hot-air. After drying, the base support paper coated with these toner image receiving layer and the back layer was further calendar-processed through a gloss calendar with a metallic roller kept at a surface temperature of 40° C. under a pressure of 14.7 kN/m$^2$ (15 kgf/cm$^2$) so as thereby to complete electrophotographic image recording paper.

The electrophotographic image recording paper of each example cut to an A-4 size was put into print to record an image thereon by means of a laser color printer such as DocuColor 1250-PF (tradename of Fuji Xerox Co., Ltd) additionally equipped with a belt fixing device 1 shown in the accompanying drawing. As shown in the single FIGURE, the belt fixing device 1 comprises a fixing belt 2 mounted between a heating roller 3 and a tension roller 5 and a cooling device 7 disposed between the heating roller 3 and the tension roller 5. The belt fixing device 1 further comprises a pressure roller 4 disposed adjacent to the heating roller 3 so as to press the fixing belt 2 against the heating roller 3 and a cleaning roller 6 disposed adjacent to the tension roller 5 so as to keep in contact with the fixing belt 2. The electrophotographic image recording paper with a latent toner image formed thereon is fed into a nip between the heating roller 3 and the pressure roller 4 from the right side in the FIGURE and moved by the fixing belt 2 for fixation. During the movement, the electrophotographic image recording paper is cooled by the cooling device 7 and cleaned by the cleaning roller 6. The belt fixing device 1 was operated to move the fixing belt 2 at a belt speed of 30 mm/sec. A nip pressure between the heating roller 3 and the pressure roller 4 was set to 0.2 MPa (2 kgf/m$^2$). Further, the heating roller 3 was kept at 150° C. for a fixing temperature, and the pressure roller 4 was kept at 120° C.

The prints formed on the electrophotographic image recording paper of the respective examples (PE1-PE6 and CE1-CE5) were comparatively assessed on image quality and glossiness. The result is shown in Table III.

<Image Quality>

The comparative assessments of image quality and glossiness were carried out by visually examination in five grades, namely from A to D as defined below.

A: Very excellent (acceptable as a high quality image recording paper)

B: Excellent (acceptable as a high quality image recording paper)

C: Average (unacceptable as a high quality image recording paper)

D: Poor (unacceptable as a high quality image recording paper)

E: Very poor (unacceptable as a high quality image recording paper)

TABLE III

| | Base Support | Image Quality | Glossiness |
|---|---|---|---|
| PE7 | PE1 | A | A |
| PE8 | PE2 | B | B |
| PE9 | PE3 | A | A |
| PE10 | PE4 | A | A |
| PE11 | PE5 | A | A |
| PE12 | PE6 | A | A |
| CE6 | CE1 | D | C |
| CE7 | CE2 | C | C |
| CE8 | CE3 | B | B |
| CE9 | CE4 | E | D |
| CE10 | CE5 | E | D |

It is proved from Table III that the electrophotographic image recording paper of practical examples PE7~PE12 are superior in both image quality and glossiness to those of comparative examples CE6~CE10.

PRACTICAL EXAMPLES PE13~PE18 AND COMPARATIVE EXAMPLES CE11 ~CE15

-Silver Salt Photographic Image Recording Medium-

Base support paper for silver salt photographic image recording paper of practical examples PE13~PE18 and comparative examples CE11~CE15) were prepared by the use of the base support paper of practical examples PE1~PE6 and comparative examples CE1~CE5), respectively. Specifically, each of the base support paper was coated with 25 μm of lower density polyethylene (LDPE) layer containing 10% by mass of $TiO_2$ on a front surface thereof kept in contact to the heating roller through extrusion coating sand with 20 μm of polyethylene (PE) layer having a mixture mass ratio of higher density polyethylene relative to lower density polyethylene (HDPE/LDPE) of 1 to a back surface thereof through extrusion coating. The base support paper was further coated with 0.1 g/m$^2$ of gelatin on the front surface after corona discharge treatment and thereafter with a silver halide emulsion on the gelatin coated surface, thereby completing silver salt photographic paper of each of the respective examples PE13~PE18 and CE11~CE15.

Each silver salt photographic paper of each example was exposed, processed and dried to provide a print. The photographic prints of the respective examples PE13~PE18 and CE11~CE15 were comparatively assessed on surface smoothness, namely microirregularities less than 1 mm and undulating irregularities from 5 to 6 mm, by visually examination in five grades, namely from A to D as defined below. The result is shown in Table IV.

A: Very excellent (acceptable as a high quality image recording paper)

B: Excellent (acceptable as a high quality image recording paper)

C: Average (unacceptable as a high quality image recording paper)

D: Poor (unacceptable as a high quality image recording paper)

E: Very poor (unacceptable as a high quality image recording paper)

TABLE IV

| | Base Support | Microirregularities | Undulating Irregularities |
|---|---|---|---|
| PE13 | PE1 | A | A |
| PE14 | PE2 | B | B |
| PE15 | PE3 | A | A |
| PE16 | PE4 | A | A |
| PE17 | PE5 | A | A |
| PE18 | PE6 | A | A |
| CE11 | CE1 | D | D |
| CE12 | CE2 | C | C |
| CE13 | CE3 | B | A |
| CE14 | CE4 | E | E |
| CE15 | CE5 | D | D |

It is proved from Table IV that the silver salt photographic paper of practical examples PE13~PE18 are superior in both surface smoothness to those of comparative examples CE11~CE15.

As described in detail above, the base support of the present invention, and hence the image recording medium comprising the base support of the present invention, has high flatness and excellent stiffness sufficiently enough for various types of image recording mediums including electrophotographic printing paper, heat sensitive printing paper, ink-jet printing paper, sublimation transfer printing paper, silver salt photographic printing paper, heat transfer printing paper and the like.

It is to be understood that although the present invention has been described with regard to a preferred embodiments thereof, various other embodiments and variants may occur to those skilled in the art, which are within the scope and spirit of the invention, and such other embodiments and variants are intended to be covered by the following claims.

What is claimed is:

1. A base support for an image recording medium comprising at least base paper satisfying a requirement of internal bond strength given by the following expression:

$$A/B \leqq 0.7$$

where A is subsurface internal bond strength defined by Japan Technical Association of the Pulp and Paper Industry, Inc. No. 54 of the base paper at a depth within ⅓ of a thickness from either one surface of the base paper, and B is central internal bond strength defined by Japan Technical Association of the Pulp and Paper Industry, Inc. No. 54 of the base paper at a depth at a depth within a range from ⅓ to ⅔ of thickness from a surface of base paper.

2. The base support for an image recording medium as defined in claim 1, wherein said base paper further satisfies a requirement of said internal bond strength given by the following expression:

$$0.3 \leqq A/B.$$

3. The base support for an image recording medium as defined in claim 1, wherein said subsurface internal bond strength is in a range from 90 to 150 mJ.

4. The base support for an image recording medium as defined in claim 1, wherein said central internal bond strength is in a range from 160 to 250 mJ.

5. The base support for an image recording medium as defined in claim 1, wherein said base paper has a thickness in a range from 50 to 250 μm.

6. The base support for an image recording medium as defined in claim 1, wherein said base paper contains an unstiffening agent in a subsurface layer thereof that is within ⅓ of a thickness from either one surface of the base paper.

7. The base support for an image recording medium as defined in claim 6, wherein said unstiffening agent comprises at least either one of a softening agent and a bulking agent.

8. The base support for an image recording medium as defined in claim 6, wherein said unstiffening agent comprises a fatty acid contained compound of a carbon number in a range from 10 to 30.

9. The base support for an image recording medium as defined in claim 8, wherein said fatty acid contained compound comprises one selected from a group including epoxydized fatty acid amide, epoxidized fatty acid diamide salts, fatty acid ester added with an alkylene oxide and fatty acid quadrihydrate ammonium salts.

10. The base support for an image recording medium as defined in claim 1, wherein said base paper has a density in a range from 0.85 to 1.15 g/cm$^3$.

11. A method of manufacturing a base support for an image recording medium comprising at least base paper satisfying a requirement of internal bond strength given by the following expression:

$$A/B \leqq 0.7$$

where A is subsurface internal bond strength defined by Japan Technical Association of the Pulp and Paper Industry, Inc. No. 54 of the base paper at a depth within ⅓ of a thickness from either one surface of the base paper, and B is central internal bond strength defined by Japan Technical Association of the Pulp and Paper Industry, Inc. No. 54 of the base paper at a depth at a depth within a range from ⅓ to ⅔ of thickness from a surface of base paper, said method comprising the steps of:

coating one of opposite surfaces of said base paper with an unstiffening agent contained liquid;

drying said base paper; and calender-processing said base paper.

12. The method of manufacturing a base support for an image recording medium as defined in claim 11, wherein said step of calender-procesing is performed using a calender machine with a metal roller at a surface temperature higher than 140° C.

13. The base support for an image recording medium as defined in claim 11, wherein said base paper further satisfies a requirement of said internal bond strength given by the following expression:

$$0.3 \leqq A/B.$$

14. The base support for an image recording medium as defined in claim 11, wherein said subsurface internal bond strength is in a range from 90 to 150 mJ.

15. The base support for an image recording medium as defined in claim 11, wherein said central internal bond strength is in a range from 160 to 250 mJ.

16. The base support for an image recording medium as defined in claim 11, wherein said base paper has a thickness in a range from 50 to 250 μm.

17. The base support for an image recording medium as defined in claim 11, wherein said base paper contains an unstiffening agent in a subsurface layer thereof that is within ⅓ of a thickness from either one surface of the base paper.

18. The base support for an image recording medium as defined in claim 17, wherein said unstiffening agent comprises at least either one of a softening agent and a bulking agent.

19. The base support for an image recording medium as defined in claim 18, wherein said fatty acid contained compound comprises one selected from a group including epoxydized fatty acid amide, epoxidized fatty acid diamide salts, fatty acid ester added with an alkylene oxide and fatty acid quadrihydrate ammonium salts.

20. The base support for an image recording medium as defined in claim 11, wherein said base paper has a density in a range from 0.85 to 1.15 g/cm$^3$.

21. The base support for an image recording medium as defined in claim 17, wherein said unstiffening agent comprises a fatty acid contained compound of a carbon number in a range from 10 to 30.

22. An image recording medium comprising a base support and an image recording layer formed on said base support, said base support comprising at least base paper satisfying a requirement of internal bond strength given by the following expression:

$$A/B \leqq 0.7$$

where A is subsurface internal bond strength defined by Japan Technical Association of the Pulp and Paper Industry, Inc. No. 54 of the base paper at a depth within ⅓ of a thickness from either one surface of the base paper, and B is central internal bond strength defined by Japan Technical Association of the Pulp and Paper Industry, Inc. No. 54 of the base paper at a depth at a depth within a range from ⅓ to ⅔ of thickness from a surface of base paper.

23. The image recording medium as defined in claim 22, wherein said image recording medium is one selected from an electrophotographic printing medium, a heat sensitive printing medium, an ink-jet printing medium, a sublimation transfer printing medium, a silver salt photographic medium, a heat transfer printing medium.

* * * * *